US009542902B2

(12) United States Patent
Ishii

(10) Patent No.: US 9,542,902 B2
(45) Date of Patent: Jan. 10, 2017

(54) DISPLAY DEVICE DRIVER

(71) Applicant: LAPIS Semiconductor Co., Ltd., Yokohama (JP)

(72) Inventor: Hiroaki Ishii, Yokohama (JP)

(73) Assignee: LAPIS SEMICONDUCTOR CO., LTD., Yokohama (JP)

( * ) Notice: Subject to any disclaimer, the term of this patent is extended or adjusted under 35 U.S.C. 154(b) by 1 day.

(21) Appl. No.: 14/610,176

(22) Filed: Jan. 30, 2015

(65) Prior Publication Data

US 2015/0221276 A1 Aug. 6, 2015

(30) Foreign Application Priority Data

Jan. 31, 2014 (JP) ..... 2014-017237

(51) Int. Cl.
*G09G 3/36* (2006.01)
*G09G 3/32* (2016.01)

(52) U.S. Cl.
CPC ..... *G09G 3/3696* (2013.01); *G09G 3/3685* (2013.01); *G09G 3/3275* (2013.01); *G09G 2310/0272* (2013.01); *G09G 2310/0278* (2013.01); *G09G 2310/0286* (2013.01); *G09G 2310/0289* (2013.01); *G09G 2310/08* (2013.01); *G09G 2320/0233* (2013.01); *G09G 2352/00* (2013.01)

(58) Field of Classification Search
CPC .. G09G 3/3696; G09G 3/3685; G09G 3/3275; G09G 2352/00; G09G 2310/0286; G09G 2310/0289; G09G 2310/0278; G09G 2310/0272; G09G 2320/0233
See application file for complete search history.

(56) References Cited

U.S. PATENT DOCUMENTS 8,520,159 B2 * 8/2013 Umezaki ..... H01L 27/1214 349/139
8,570,267 B2 * 10/2013 Ohtsubo ..... G09G 3/3666 345/100
8,593,447 B2 * 11/2013 Hasegawa ..... G09G 3/3696 345/212

FOREIGN PATENT DOCUMENTS

JP 2010-039061 A 2/2010

* cited by examiner

*Primary Examiner* — Andrew Sasinowski
(74) *Attorney, Agent, or Firm* — Rabin & Berdo, P.C.

(57) ABSTRACT

A display device driver that can display images while preventing noise and suppressing display unevenness is provided. When pixel drive voltages corresponding to the luminance levels of respective pixels indicated by a video signal are applied to the data lines of the display device, the pixel drive voltages are applied to data lines that intersect the scanning lines of the display device at positions where the delay time is larger, at timing later than timing of applying the pixel drive voltages to the data lines that intersect the scanning lines at positions where the delay time is smaller, the delay time being a period of time between start of application of the scanning pulse by the scanning driver and actual arrival of the scanning pulse.

8 Claims, 17 Drawing Sheets

DISPLAY DEVICE DRIVER

BACKGROUND OF THE INVENTION

1. Field of the Invention

The present invention relates to a display device driver that drives a display device in response to a video signal.

2. Background Art

In display devices such as liquid crystal displays, pixels are formed at crossing parts between a plurality of scanning lines extending in a horizontal direction on a two-dimensional screen and a plurality of signal lines extending in a vertical direction on the two-dimensional screen. Such a display panel incorporates a signal driver that applies voltages, which correspond to the luminance levels of pixels each indicated by video data, to the respective signal lines. The display panel also incorporates a scanning driver that applies scanning voltages to the respective scanning lines in sequence.

As a display apparatus that incorporates such drivers, there is proposed an apparatus configured to divide a plurality of pieces of video data for one horizontal period into groups and to shift voltage application timing of the video data groups in units of video data groups. With this configuration, the apparatus avoids the situation where steep change in currents simultaneously occurs in signal line groups and thereby prevents noise generated in such a situation (see, for example, Japanese Patent Application Laid-Open No. 2010-39061).

As the size of the display panel increases, interconnection resistance of the scanning lines extending in the horizontal direction on the two-dimensional screen increases in particular. As a result, scanning signals on the scanning lines have a larger delay amount due to the interconnection resistance as they are more distant from the scanning driver. Therefore, when voltages (hereinafter referred to as pixel drive voltages) corresponding to the luminance levels slowly rise on the signal lines, voltage values of the pixel drive voltages, defined in the respective pixels while the scanning voltages are applied, are higher in the pixels placed at positions (on the scanning lines) where the delay amount of the scanning signals is larger. This causes so-called display unevenness, that is, variations in display luminance depending on pixel positions.

SUMMARY OF THE INVENTION

Accordingly, an object of the present invention is to provide a display device driver that can display images while preventing noise and suppressing display unevenness.

The display device driver according to the present invention is a display device driver for driving a display device in accordance with a video signal, the display device including scanning lines and a plurality of data lines that intersect the scanning lines, the driver including: a scanning driver that applies a scanning pulse to the scanning lines; and a data driver that applies pixel drive voltages to the respective data lines, the pixel drive voltages corresponding to luminance levels of respective pixels indicated by the video signal, wherein the data driver applies the pixel drive voltages to data lines that intersect the scanning lines at positions where delay time is larger, at timing later than timing of applying the pixel drive voltages to the data lines that intersect the scanning lines at positions where the delay time is smaller, the delay time being a period of time between start of application of the scanning pulse by the scanning driver and arrival of the scanning pulse.

According to the present invention, it becomes possible to avoid the situation of steep and simultaneous change in currents that flow into the respective data lines when pixel drive voltages are applied to the display device so as to prevent noise and suppress display unevenness caused by the interconnection resistance of the display device.

DETAILED DESCRIPTION OF THE INVENTION

Hereinbelow, embodiments of the present invention will be described in detail with reference to the accompanying drawings.

Figure 1:
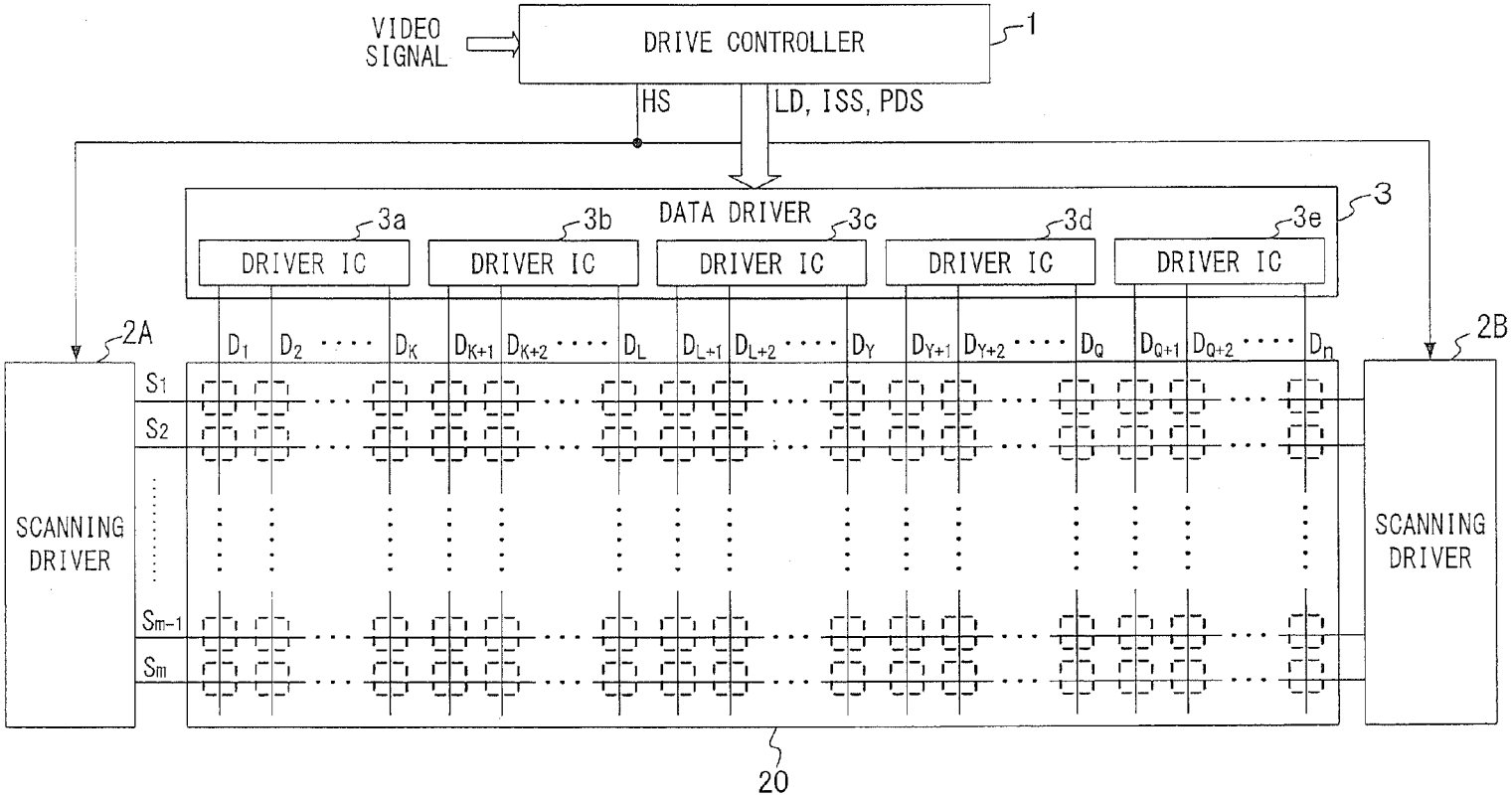
FIG. 1 is a block diagram illustrating a display apparatus including a display device driver according to the present invention.

FIG. 1 is a schematic configuration view of a display apparatus including a display device driver according to the present invention. As illustrated in FIG. 1, this display apparatus includes a drive controller 1, scanning drivers 2A and 2B, a data driver 3, and a display device 20.

For example, the display device 20 is made of a liquid crystal or organic EL panel. The display device 20 has m (m is a natural number of 2 or more) horizontal scan lines $S_1$ to $S_m$ each formed to extend in a horizontal direction on a two-dimensional screen and n (n is a natural number of 2 or more) data lines $D_1$ to $D_n$ each formed to extend in a vertical direction on the two-dimensional screen. A display cell that holds a pixel is formed in each of crossing parts between the horizontal scan lines and the data lines.

The drive controller 1 extracts a horizontal synchronizing signal from a video signal, and supplies the horizontal synchronizing signal as a horizontal synchronizing signal HS to the scanning driver 2A and 2B. In synchronization with the horizontal synchronizing signal, the drive controller generates a load signal LD indicative of the timing to start capturing of pixel data, and supplies the load signal LD to the data driver 3. Based on the video signal, the drive controller 1 also generates a sequence of pixel data PD that represents the luminance level of each pixel in eight bits for example, and superimposes a reference timing signal RS indicative of the timing of a clock signal on the sequence of pixel data PD to generate a pixel data signal PDS. The pixel data signal PDS is supplied to the data driver 3. The drive controller 1 further supplies to the data driver 3 an initial setting signal ISS for initial setting of each driver IC (described later) formed in the data driver 3. The initial setting signal ISS represents, for example, load delay time information LI and delay mode information DM. The load delay time information LI specifies the information corresponding to load delay time that is a period of time from supply point of the above-stated load signal LD to actual start point of loading the pixel data. The delay mode information DM specifies a delay mode (described later).

The scanning driver 2A is connected to one end of each of the horizontal scan lines $S_1$ to $S_m$. The scanning driver 2B is connected to the other end of each of the horizontal scan lines $S_1$ to $S_m$. The scanning drivers 2A and 2B generate a horizontal scanning pulse SP in synchronization with the above-stated horizontal synchronizing signal HS, and apply the horizontal scanning pulse SP to each of the horizontal scan lines $S_1$ to $S_m$ of the display device 20 in sequence.

The data driver 3 captures the sequence of pixel data PD in the pixel data signal PDS in response to the load signal LD in accordance with the operation mode (described later) set on the basis of the above-stated initial setting signal ISS. Whenever the pixel data PD for one horizontal scan line, i.e., n (n is the total number of data lines) pieces of pixel data PD, are captured, the data driver 3 converts the captured n pieces of pixel data PD into pixel drive voltages having voltage values corresponding to the luminance levels indicated by the respective pieces of PD, and applies the pixel drive voltages to the data lines $D_1$ to $D_n$ of the display device 20.

The data driver 3 is formed from a plurality of semiconductor integrated circuit (IC) chips each having the same circuitry. For example, in an embodiment illustrated in FIG. 1, the data driver 3 is formed from five driver ICs 3*a* to 3*e*. In this case, out of n pieces of pixel data PD for one horizontal scan line, the driver IC 3*a* captures K (K is a natural number of 2 or more) pieces of pixel data PD corresponding to first to K-th columns of the display device 20. The driver IC 3*a* then applies pixel drive voltages $G_1$ to $G_K$ corresponding to the luminance levels indicated by the respective pieces of the pixel data PD to the data lines $D_1$ to $D_K$ of the display device 20. Out of n pieces of pixel data PD for one horizontal scan line, the driver IC 3*b* captures K pieces of pixel data PD corresponding to (K+1)-th column to L-th column (L=2×K) of the display device 20. The driver IC 3*b* then applies pixel drive voltages $G_{K+1}$ to $G_L$ corresponding to the luminance levels indicated by the respective pieces of pixel data PD to the data lines $D_{K+1}$ to $D_L$ of the display device 20. Out of n pieces of pixel data PD for one horizontal scan line, the driver IC 3*c* captures K pieces of pixel data PD corresponding to (L+1)-th column to Y-th column (Y=3×K) of the display device 20. The driver IC 3*c* then applies pixel drive voltages $G_{L+1}$ to $G_Y$ corresponding to the luminance levels indicated by the respective pieces of pixel data PD to the data lines $D_{L+1}$ to $D_Y$ of the display device 20. Out of n pieces of pixel data PD for one horizontal scan line, the driver IC 3*d* captures K pieces of pixel data PD corresponding to (Y+1)-th column to Q-th column (Q=4×K) of the display device 20. The driver IC 3*d* then applies pixel drive voltages $G_{Y+1}$ to $G_Q$ corresponding to the luminance levels indicated by the respective pieces of pixel data PD to the data lines $D_{Y+1}$ to $D_Q$ of the display device 20. Out of n pieces of pixel data PD for one horizontal scan line, the driver IC 3*e* captures K pieces of pixel data PD corresponding to (Q+1)-th column to n-th column of the display device 20. The driver IC 3*e* then applies pixel drive voltages $G_{Q+1}$ to $G_n$ corresponding to the luminance levels indicated by the respective pieces of pixel data PD to the data lines $D_{Q+1}$ to $D_n$ of the display device 20.

More specifically, the driver ICs 3*a* and 3*b* for driving a screen left area of the display device 20, the driver IC 3*c* for driving a screen center area, and the driver ICs 3*d* and 3*e* for driving a screen right area are placed along one side of the display device 20 as illustrated in FIG. 1.

Since the circuit formed in each of the driver ICs 3*a* to 3*e* is identical, the configuration formed in each driver IC will be described by using the driver IC 3*a*.

Figure 2:
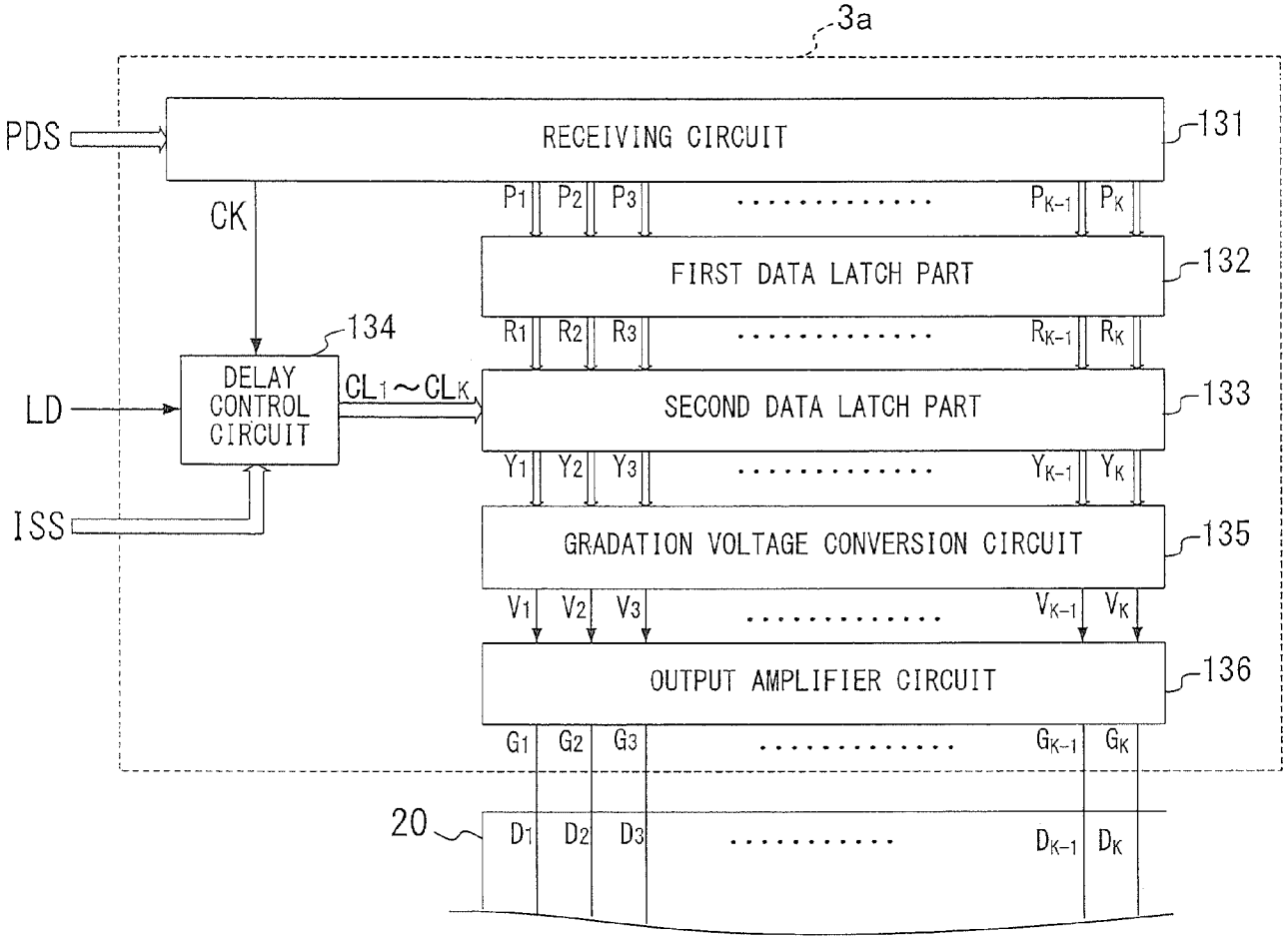
FIG. 2 is a block diagram illustrating an example of the internal configuration of a driver IC 3*a;*

FIG. 2 is a block diagram illustrating the circuit formed in the driver IC 3*a*. As illustrated in FIG. 2, each of the driver ICs includes a receiving circuit 131, a first data latch part 132, a second data latch part 133, a delay control circuit 134, a gradation voltage conversion circuit 135, and an output amplifier circuit 136.

The receiving circuit 131 captures a sequence of pixel data PD from a pixel data signal PDS supplied from the drive controller 1, and supplies the pixel data PD for one horizontal scan line (n pieces) to the first data latch part as pixel data $P_1$ to $P_K$. The receiving circuit 131 extracts a reference timing signal RS from the pixel data signal PDS, and reproduces a reference clock signal CK that is phase-locked to the reference timing signal RS. The receiving circuit 131 then supplies the reference clock signal CK to the delay control circuit 134.

The first data latch part 132 captures each of the pixel data $P_1$ to $P_K$ supplied from the receiving circuit 131 in order of being supplied, and supplies the captured data as pixel data $R_1$ to $R_K$ to the subsequent second data latch part 133.

The delay control circuit 134 performs initial setting in accordance with an initial setting signal ISS supplied from the drive controller 1. In an operation mode based on the initial setting, the delay control circuit 134 generates delay capture clock signals $CL_1$ to $CL_K$ each having different edge timing and synchronized with the reference clock signal CK, in response to the above-stated load signal LD, and supplies delay capture clock signals $CL_1$ to $CL_K$ to the second data latch part 133.

Figure 3:
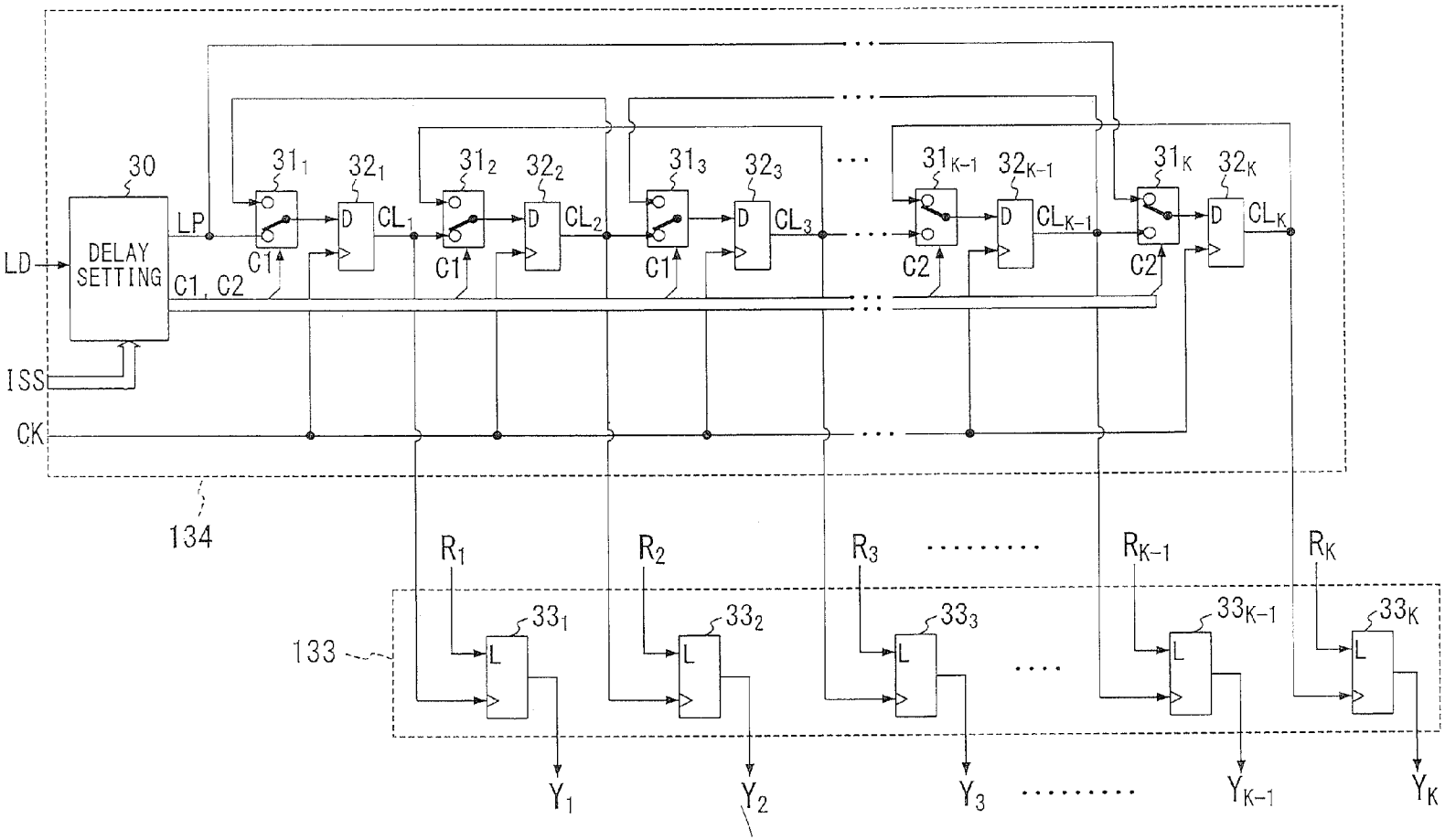
FIG. 3 is a circuit diagram illustrating an example of the internal configuration of a delay control circuit 134 and a second data latch part 133.

FIG. 3 is a circuit diagram illustrating an example of the internal configuration of each of the second data latch part 133 and delay control circuit 134. The delay control circuit 134 includes a delay setting part 30, K shift direction switches $31_1$ to $31_K$, and K D-flip-flops (hereinafter referred to as DFFs) $32_1$ to $32_K$.

In FIG. 3, the delay setting part 30 first stores the load delay time information LI and the delay mode information DM indicated by the initial setting signal ISS supplied from the drive controller 1 in a built-in register (not illustrated). When the delay mode specified by the delay mode information DM is L shift mode (first shift mode), the delay setting part 30 supplies a switching signal C1 with a logic level 0 to the shift direction switches $31_1$ to $31_{(K/2)}$, while supplying a switching signal C2 with a logic level 0 to the shift direction switches $31_{(1+K/2)}$ to $31_K$. When the delay mode specified by the delay mode information DM is R shift mode (second shift mode), the delay setting part 30 supplies a switching signal C1 with a logic level 1 to the shift direction switches $31_1$ to $31_{(K/2)}$, while supplying a switching signal C2 with a logic level 1 to the shift direction switches $31_{(1+K/2)}$ to $31_K$. When the delay mode specified by the delay mode information DM is V shift mode (third shift mode), the delay setting part 30 supplies a switching signal C1 with a logic level 0 to the shift direction switches $31_1$ to $31_{(K/2)}$, while supplying a switching signal C2 with a logic level 1 to the shift direction switches $31_{(1+K/2)}$ to $31_K$.

Furthermore, when the load signal LD is supplied from the drive controller 1, the delay setting part 30 generates a load signal LP of a single pulse at the time when load delay time indicated by the load delay time information LI is passed after reception of the load signal LD. The delay setting part then supplies the generated load signal LP to the shift direction switches $31_1$ and $31_K$.

The DFFs $32_1$ to $32_K$ each have a clock input terminal to which a reference clock signal CK is commonly supplied. As illustrated in FIG. 3, the DFFs $32_1$ to $32_K$ are also connected in series via the shift direction switch 31 provided prior to each of the DFFs. That is, the shift direction switches $31_1$ to $31_K$ and the DFFs $32_1$ to $32_K$ operate as a shift register which sequentially shifts the load signal LP to the subsequent DFFs in response to the reference clock signal CK. Outputs of the respective DFFs $32_1$ to $32_K$ are supplied to the second data latch part 133 as delay capture clock signals $CL_1$ to $CL_K$. Here, a shift direction switch $31w$ (W is a natural number of 2 to [K−1]) selects one of a delay capture clock signal $CL_{W-1}$ output from the DFF $32_{W-1}$ and a delay capture clock signal $CL_{W+1}$ output from the DFF $32_{W+1}$ in accordance with the switching signal C1 or C2, and supplies the selected signal to the DFF $32_W$. The shift direction switch $31_1$ selects one of the load signal LP and the delay capture clock signal $CL_2$ output from the DFF $32_2$ in accordance with the switching signal C1, and supplies the selected signal to the DFF $32_1$. The shift direction switch $31_K$ selects one of the load signal LP and the delay capture clock signal $CL_K-1$ output from the DFF $32_K-1$ in accordance with the switching signal C2, and supplies the selected signal to the DFF $32_K$.

Figure 4:
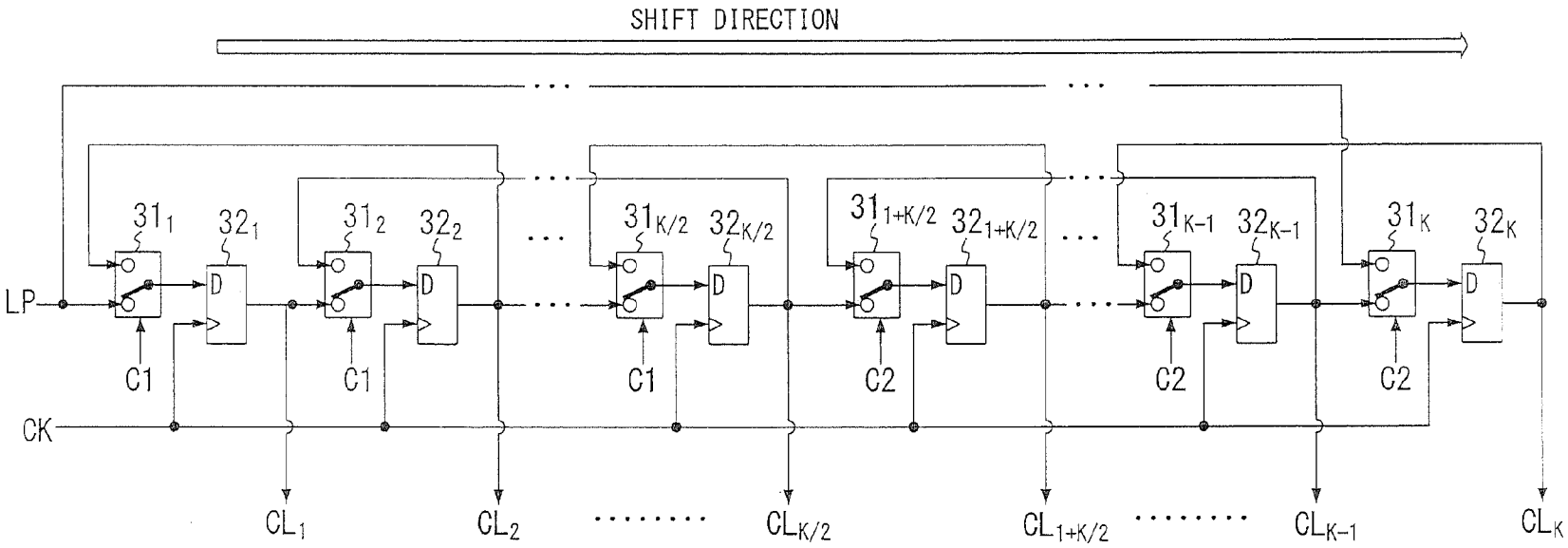
FIG. 4 illustrates switch states of shift direction switches $\mathbf{31}_1$ to $\mathbf{31}_K$ in L shift mode.
Figure 5:
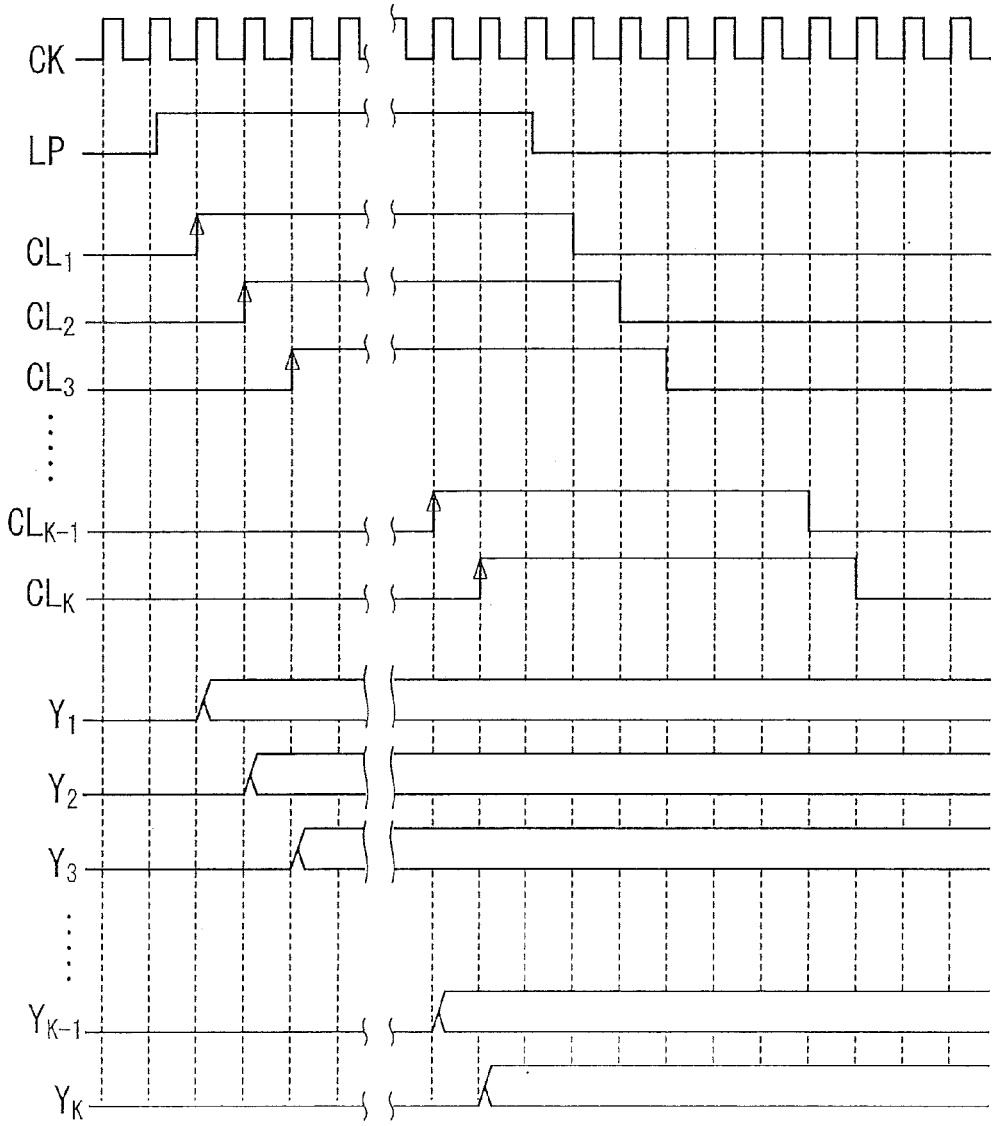
FIG. 5 is a time chart illustrating internal operation of the delay control circuit 134 in the L shift mode.

With this configuration, when the delay mode specified by the delay mode information DM is the L shift mode, a shift direction switch $31_S$ (S is a natural number of 2 to K) selects a delay capture clock signal $CL_{S-1}$ output from the DFF $32_{S-1}$ in accordance with the switching signal C1 or C2 with a logic level 0, and supplies the selected signal to the DFF $32_S$ as illustrated in FIG. 4. Furthermore, in this L shift mode, the shift direction switch $31_1$ selects the load signal LP and supplies the load signal LP to the DFF $32_1$. As a result, in the L shift mode, the load signal LP is first captured into the DFF $32_1$ in synchronization with the reference clock signal CK and then continues to be captured while being shifted to subsequent DFFs in order of the DFFs $32_2$, $32_3$, . . . , $32_K-1$, and $32_K$ in synchronization with the reference clock signal CK. As a consequence, the DFFs $32_1$ to $32_K$ generate delay capture clock signals $CL_1$ to $CL_K$ with their edge timing sequentially delayed by one cycle of the reference clock signal CK in order of $CL_1$, $CL_2$, $CL_3$, . . . , $CL_K-1$, and $CL_K$ as illustrated in FIG. 5. The DFFs $32_1$ to $32_K$ then supply the generated signals to the second latch part 133.

Figure 6:
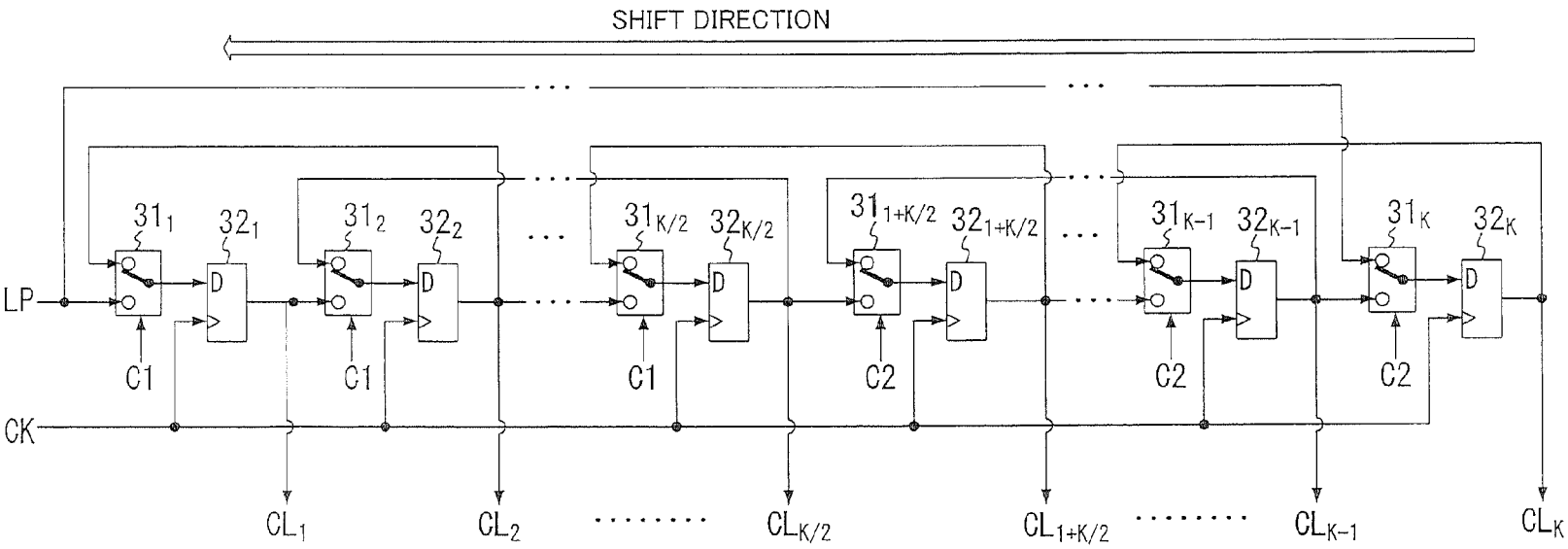
FIG. 6 illustrates the switch states of the shift direction switches $\mathbf{31}_1$ to $\mathbf{31}_K$ in R shift mode.
Figure 7:
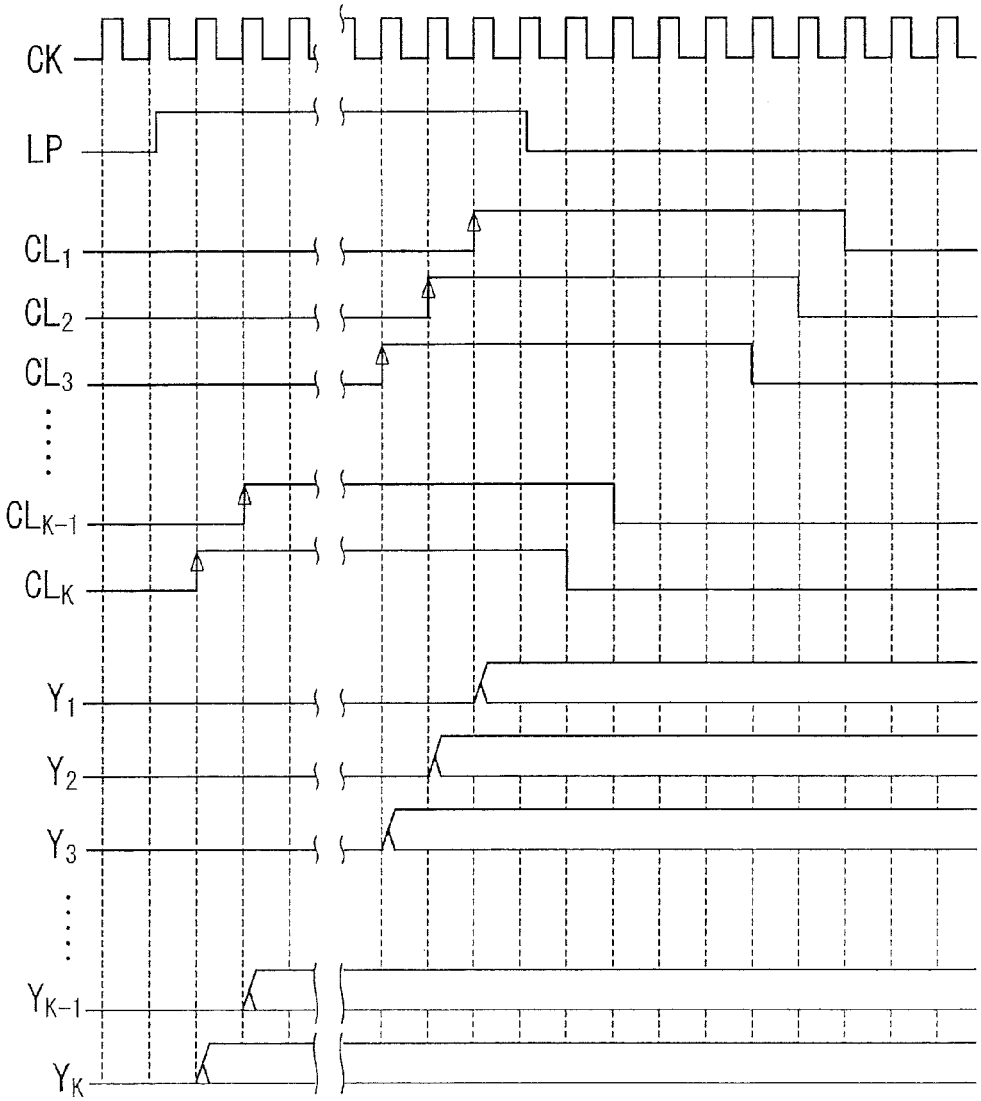
FIG. 7 is a time chart illustrating internal operation of the delay control circuit 134 in the R shift mode.

When the delay mode specified by the delay mode information DM is the R shift mode, a shift direction switch $31_J$ (J is a natural number of 1 to K−1) selects a delay capture clock signal $CL_{J+1}$ output from the DFF $32_{J+1}$ in accordance with the switching signal C1 or C2 with a logic level 1, and supplies the selected signal to the DFF $32_J$ as illustrated in FIG. 6. Furthermore, in this R shift mode, the shift direction switch $31_K$ selects the load signal LP and supplies the load signal LP to the DFF $32_K-1$. As a consequence, in the R shift mode, the load signal LP is first captured into the DFF $32_K$ in synchronization with the reference clock signal CK, and then continues to be captured while being sequentially shifted to subsequent DFFs in order of $32_K-1$, $32_K-2$, . . . , $32_3$, $32_2$ and $32_1$ in synchronization with the reference clock signal CK. As a consequence, the DFFs $32_1$ to $32_K$ generate delay capture clock signals $CL_1$ to $CL_K$ with their edge timing sequentially delayed by one cycle of the reference clock signal CK in order of $CL_K$, $CL_{K-1}$, . . . , $CL_3$, $CL_2$, and $CL_1$ as illustrated in FIG. 7. The DFFs $32_1$ to $32_K$ then supply the generated signals to the second latch part 133.

Figure 8:
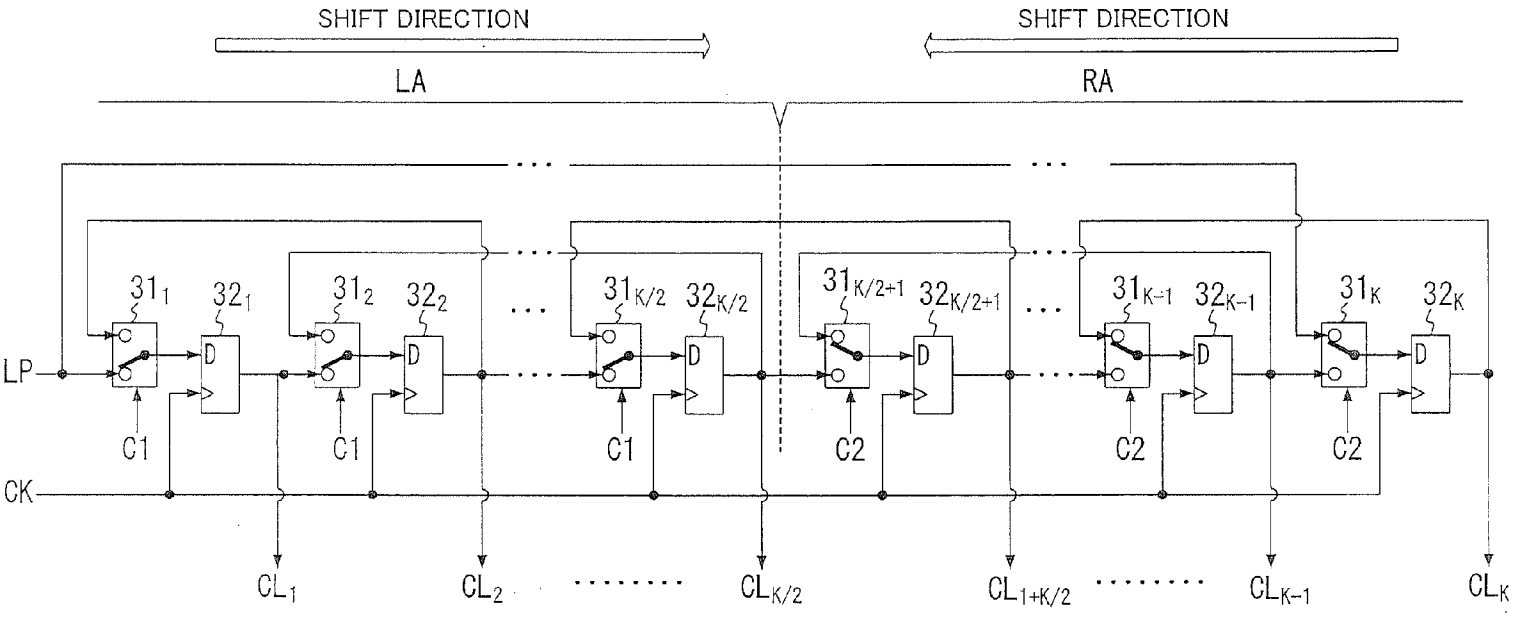
FIG. 8 illustrates switch states of the shift direction switches $\mathbf{31}_1$ to $\mathbf{31}_K$ in V shift mode.
Figure 9:
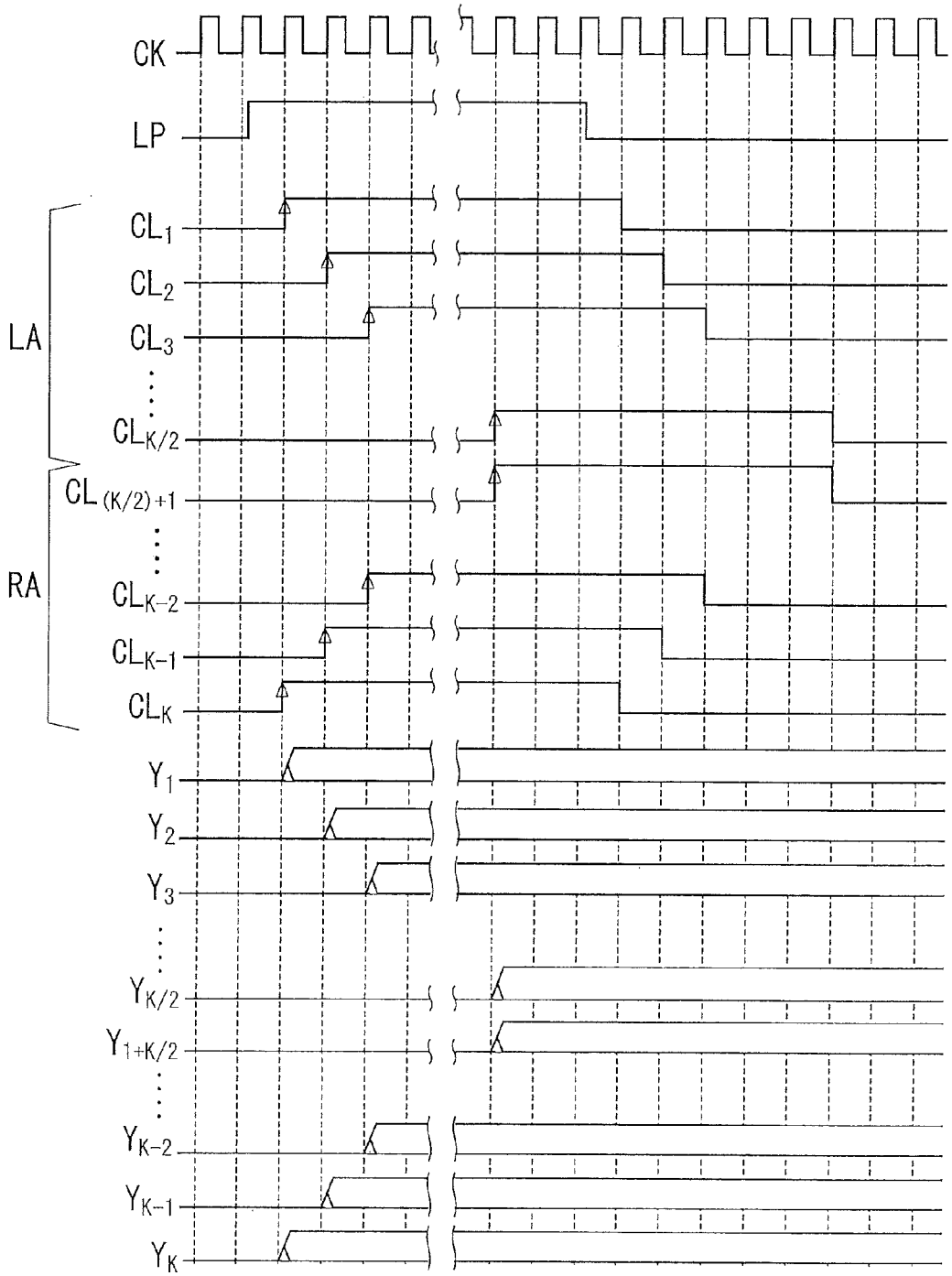
FIG. 9 is a time chart illustrating internal operation of the delay control circuit 134 in the V shift mode.

When the delay mode specified by the delay mode information DM is V shift mode, a shift direction switch $31_T$ (T is a natural number of 2 to K/2) belonging to a left area LA among the shift direction switches $31_1$ to $31_K$ selects a delay capture clock signal $CL_{T-1}$ output from a DFF $32_{T-1}$, and supplies the selected signal to a DFF $32_T$ as illustrated in FIG. 8. Furthermore, in this V shift mode, the shift direction switch $31_1$ belonging to the left area LA selects the load signal LP and supplies the load signal LP to the DFF $32_1$. In the V shift mode, a shift direction switch $31_H$ (H is a natural number of 1+K/2 to K−1) belonging to a right area RA among the shift direction switches $31_1$ to $31_K$ selects a delay capture clock signal $CL_{H+1}$ output from a DFF $32_{H+1}$, and supplies the selected signal to a DFF $32_H$. Furthermore, in this V shift mode, the shift direction switch $31_K$ belonging to the right area RA selects the load signal LP and supplies the load signal LP to the DFF $32_K$. Accordingly, in the V shift mode, the load signal LP is first captured into each of the DFFs $32_1$ and $32_K$ in synchronization with the reference clock signal CK, and then continues to be captured into each of the DFFs 32 which belong to the left area LA and the right area RA in synchronization with the reference clock signal CK as described below. That is, in the left area LA, the load signal LP is captured while being shifted to subsequent DFFs in order of the DFFs $32_2$, $32_3$, . . . , $32_{(K/2)-1}$, and $32_{K/2}$. In the right area RA, the load signal LP is captured while being shifted to subsequent DFFs in order of DFFs $32_{K-1}$, $32_{K-2}$, $32_{K-3}$, . . . , and $32_{(K/2)+1}$. As a consequence, the DFFs $32_1$ to $32_{K/2}$ belonging to the left area LA generate delay capture clock signals $CL_1$ to $CL_{K/2}$ with their edge timing sequentially delayed by one cycle of the reference clock signal CK in order of $CL_1$, $CL_2$, $CL_3$, . . . , and $CL_{K/2}$ as illustrated in FIG. 9. The DFFs $32_1$ to $32_{K/2}$ then supply the generated signals to the second latch part 133. The DFF $32_{(K/2)+1}$, $32_{(K/2)+2}$, . . . $32_{K-1}$, and $32_K$ belonging to the right area RA generate delay capture clock signals $CL_{(K/2)+1}$ to $CL_K$ with their edge timing sequentially delayed by one cycle of the reference clock signal CK in order of $CL_K$, $CL_{K-1}$, $CL_{K-2}$, . . . , and $CL_{(K/2)+1}$ as illustrated in FIG. 9. The DFFs $\mathbf{32}_{(K/2)+1}$ to $\mathbf{32}_K$ then supply the generated signals to the second latch part 133.

The second data latch part 133 has K latches $\mathbf{33}_1$ to $\mathbf{33}_K$. The latches $\mathbf{33}_1$ to $\mathbf{33}_K$ individually capture pixel data $R_1$ to $R_K$ supplied from the first data latch part 132 in synchronization with the above-stated delay capture clock signals $CL_1$ to $CL_K$, and supply the respective captured pixel data $R_1$ to $R_K$ as pixel data $Y_1$ to $Y_K$ to the gradation voltage conversion circuit 135.

The gradation voltage conversion circuit 135 converts the pixel data $Y_1$ to $Y_K$ into pixel drive voltages $V_1$ to $V_K$ having voltage values corresponding to their luminance levels, and supplies the pixel drive voltages $V_1$ to $V_K$ to the output amplifier circuit 136. The output amplifier circuit 136 amplifies each of the pixel drive voltages $V_1$ to $V_K$ to desired values, and applies the amplified pixel drive voltages $V_1$ to $V_K$ as pixel drive voltages $G_1$ to $G_K$ to data lines $D_1$ to $D_K$ of the display device 20, respectively.

Figure 10A:
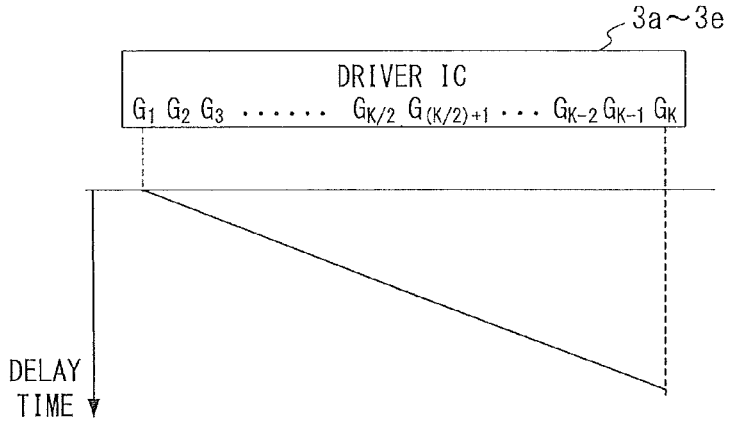
FIGS. 10A, 10B, and 10C illustrate the configuration of delay in the pixel drive voltages G applied to respective data lines in each delay mode.
Figure 10B:
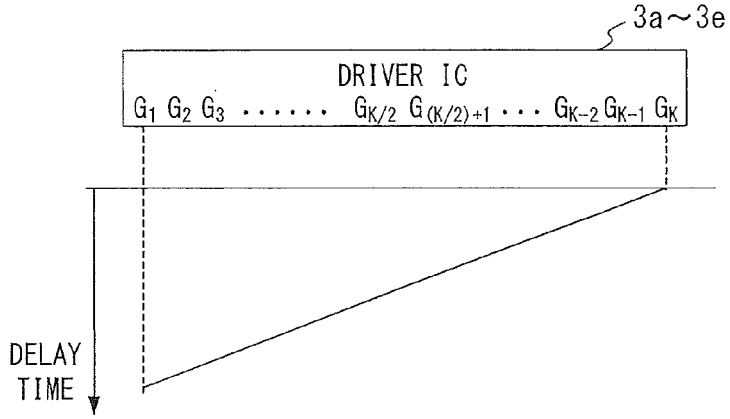
Figure 10C:
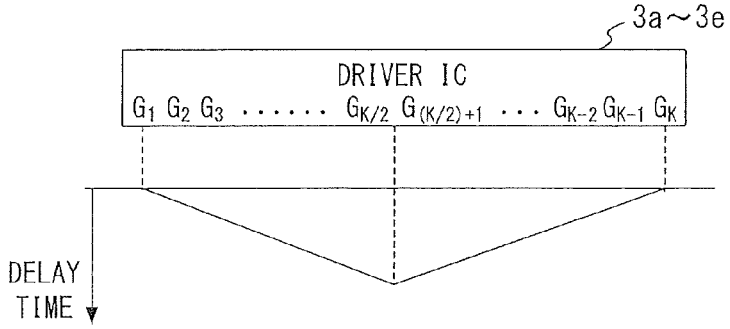

With the above configuration, the driver ICs 3*a* to 3*e* each apply the above-stated pixel drive voltages $G_1$ to $G_K$ to the respective data lines D of the display device 20 when the load delay time indicated by the load delay time information LI is passed after reception of the load signal LD and then the delay time based on the delay mode specified by the delay mode information DM is further passed. For example, when the delay mode specified by the delay mode information DM is the L shift mode, the driver ICs 3*a* to 3*e* each apply the respective pixel drive voltages G to the data lines D at application timing delayed in order of the pixel drive voltages $G_1$, $G_2$, $G_3$, . . . , and $G_K$ as illustrated in FIG. 10A. When the delay mode is the R shift mode, the driver ICs 3*a* to 3*e* each apply the respective pixel drive voltages G to the data lines D at application timing delayed in order of the pixel drive voltages $G_K$, $G_{K-1}$, $G_{K-2}$, . . . $G_2$ and $G_1$ as illustrated in FIG. 10B. When the delay mode is the V shift mode, the driver ICs 3*a* to 3*e* each apply the respective pixel drive voltages G to the data lines D at application timing delayed in order of the pixel drive voltages ($G_1$, $G_K$), ($G_2$, $G_{K-1}$) ($G_3$, $G_{K-2}$) . . . ($G_{K/2}$, $G_{(K/2)+1}$) as illustrated in FIG. 10C.

A description is now given of the operation by the above-stated drive controller 1 and the driver ICs 3*a* to 3*e*.

First, the drive controller 1 supplies an initial setting signal ISS, which is used for initial setting of each of the driver ICs 3*a* to 3*e* of the data driver 3, to the data driver 3.

More specifically, the drive controller 1 supplies to the driver ICs 3*a* and 3*b* which drive the screen left area of the display device 20, an initial setting signal ISS including delay mode information DM for specifying the L shift mode. The drive controller 1 supplies to the driver IC 3*a* placed in the leftmost end, an initial setting signal ISS further including load delay time information LI indicative of the load delay time of zero, i.e., no delay time. The drive controller 1 supplies to the driver IC 3*b* placed next to the left end, an initial setting signal ISS further including load delay time information LI indicative of load delay time T1. The load delay time T1 is, for example, a period of time from supply point of the delayed load signal LD to start point of application of the pixel drive voltage G which is applied the latest in the driver IC 3*a* adjacent to the driver IC 3*b* on the left side.

The drive controller 1 supplies to the driver IC 3*c* which drives the screen center area of the display device 20, an initial setting signal ISS including delay mode information DM for specifying the V shift mode and load delay time information LI indicative of the load delay time T2. The load delay time T2 is, for example, a period of time between supply of the delayed load signal LD and start of application of the pixel drive voltage G which is applied the latest in the driver IC 3*b* adjacent to the driver IC 3*c* on the left side.

The drive controller 1 supplies to the driver ICs 3*d* and 3*e* which drive the screen right area of the display device 20, an initial setting signal ISS including delay mode information DM for specifying the R shift mode. The drive controller 1 supplies to the driver IC 3*e* placed in the rightmost end, an initial setting signal ISS further including load delay time information LI indicative of the load delay time of zero, i.e., no delay time. The drive controller 1 supplies to the driver IC 3*d* placed next to the right end, an initial setting signal ISS further including load delay time information LI indicative of load delay time T2. The load delay time T2 is, for example, a period of time from supply point of the delay load signal LD to start point of application of the pixel drive voltage G which is applied the latest in the driver IC 3*e* adjacent to the driver IC 3*d* on the right side.

Figure 11:
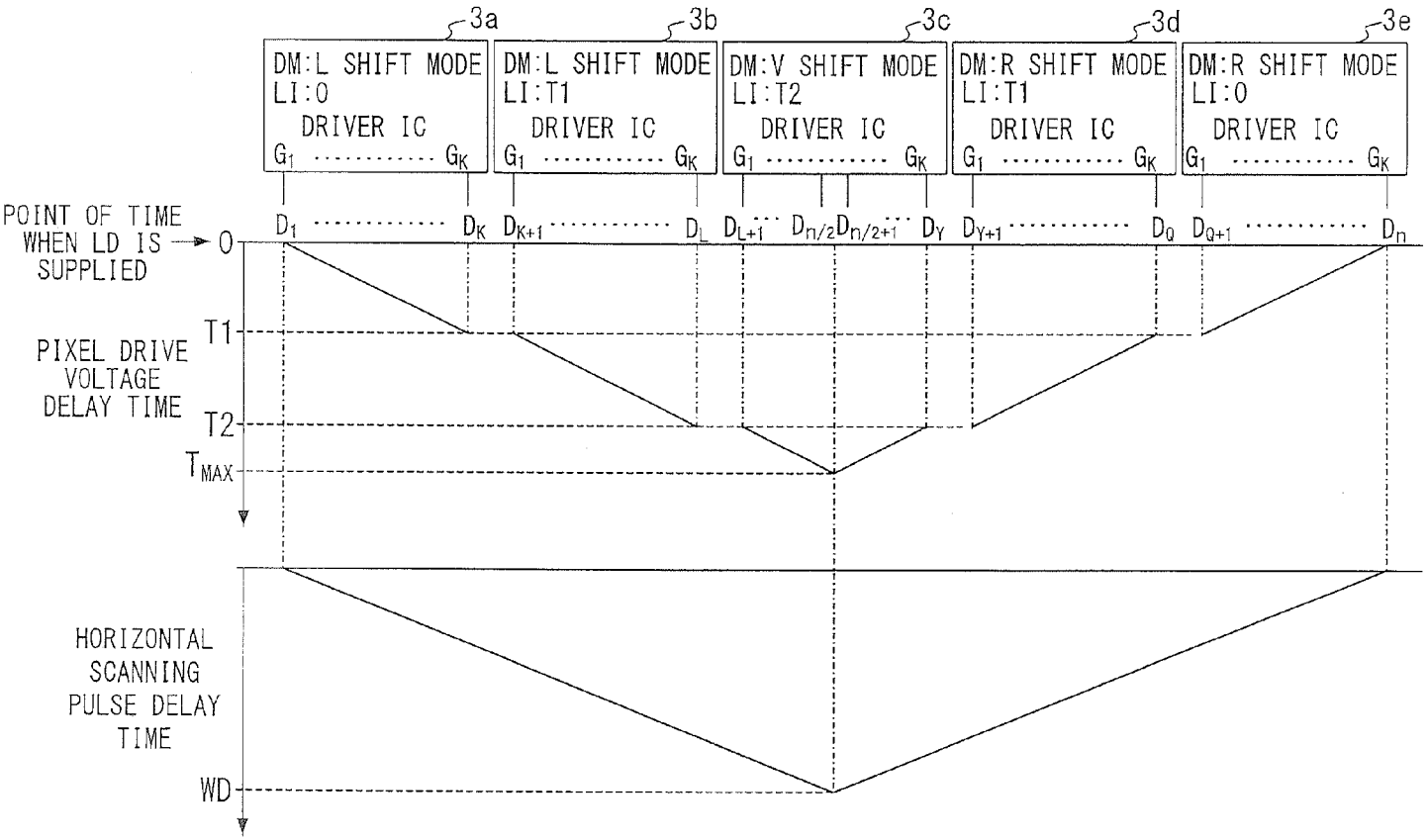
FIG. 11 illustrates the configuration of delay in the pixel drive voltages G applied to data lines $D_1$ to $D_n$ and the configuration of delay in a horizontal scanning pulse at each position on horizontal scan lines S.

Once the initial setting is performed on the basis of the above-stated initial setting signal ISS, the driver ICs 3*a* to 3*e* apply to each of the data lines D connected to the respective driver ICs, the pixel drive voltages G with the delay configured in accordance with the load delay time information LI and the delay mode information DM as illustrated in FIG. 11.

More specifically, first, in response to the load signal LD supplied from the drive controller 1, the driver ICs 3*a* and 3*e*, among the driver ICs 3*a* to 3*e*, start application of the pixel drive voltages G to the respective data lines D. In accordance with the L shift mode illustrated in FIG. 10A, the driver IC 3*a* sequentially applies pixel drive voltages $G_1$ to $G_K$ with their application timing delayed in order of $G_1$, $G_2$, $G_3$, . . . and $G_K$ to the data lines $D_1$, D2, D3, . . . and $D_K$ of the display device 20 as illustrated in FIG. 11. In accordance with the R shift mode illustrated in FIG. 10B, the driver IC 3*e* sequentially applies pixel drive voltages $G_1$ to $G_K$ with their application timing delayed in order of $G_K$, $G_{K-1}$, $G_{K-2}$, . . . $G_2$ and $G_1$ to the data lines $D_n$, $D_{n-1}$, $D_{n-2}$, . . . , $D_{Q+1}$ as illustrated in FIG. 11.

Once the load delay time TI indicated by the load delay time information LI is passed after the point of time when the load signal LD is supplied, the driver ICs 3*b* and 3*d* start application of the pixel drive voltages G to the respective data lines D. In accordance with the L shift mode illustrated in FIG. 10A, the driver IC 3*b* sequentially applies pixel drive voltages $G_1$ to $G_K$ with their application timing delayed in order of $G_1$, $G_2$, $G_3$, . . . and $G_K$ to the data lines $D_{K+1}$, $D_{K+2}$, $D_{K+3}$, . . . , $D_L$ of the display device 20 as illustrated in FIG. 11. In accordance with the R shift mode illustrated in FIG. 10B, the driver IC 3*d* sequentially applies pixel drive voltages $G_1$ to $G_K$ with their application timing delayed in order of $G_K$, $G_{K-1}$ $G_{K-2}$, . . . $G_2$ and $G_1$ to the data lines $D_Q$, $D_{Q-1}$, $D_{Q-2}$, . . . , $D_{Y+2}$, and $D_{Y+1}$ of the display device 20 as illustrated in FIG. 11.

Once the load delay time T2 indicated by the load delay time information LI is passed after the point of time when the load signal LD is supplied, the driver IC3*c* starts application of the pixel drive voltages G to the respective data lines D. More specifically, in accordance with the V shift mode illustrated in FIG. 10C, the driver IC 3*c* sequentially applies pixel drive voltages $G_1$ to $G_K$ with their application timing delayed in order of ($G_1$, $G_K$), ($G_2$, $G_{K-1}$), ($G_3$, $G_{K-2}$), . . . and ($G_{K/2}$, $G_{(K/2)+1}$) to the data lines ($D_{L+1}$, $D_Y$), ($D_{L+2}$, $D_{Y-1}$), ($D_{L+3}$, $D_{Y-2}$), . . . , and ($D_{n/2}$, $D_{(n/2)+1}$) of the display device 20 as illustrated in FIG. 11.

When a horizontal scanning pulse SP is applied to a horizontal scan line S among the horizontal scan lines $S_1$ to $S_m$ of the display device 20, the display cells belonging to the horizontal scan line S perform display with luminance levels corresponding to the pixel drive voltages G applied to each of the data lines $D_1$ to $D_n$.

Figure 12:
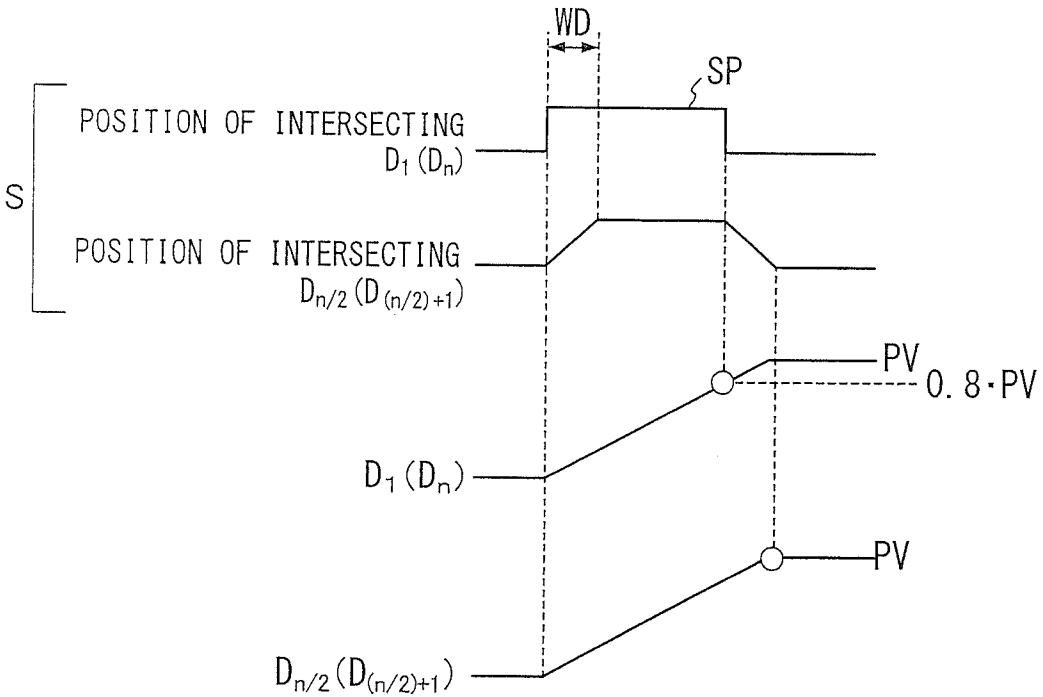
FIG. 12 is a waveform chart illustrating pixel drive voltages and horizontal scanning pulses when the pixel drive voltages are simultaneously applied to a data line $D_1$ (or $D_n$) belonging to a screen left (or right) end area and a data line $D_{n/2}$ (or $D_{(n/2)+1}$) belonging to a screen center area.

As the size of the display device 20 increases, the interconnection resistance of the horizontal scan lines S extending in the horizontal direction of the two-dimensional screen becomes larger in particular. Accordingly, in order to reduce the load of the scanning drivers caused by the interconnection resistance, the scanning drivers (2A, 2B) are provided on both ends of the horizontal scan lines S in the display apparatus illustrated in FIG. 1. On each of the horizontal scan lines $S_1$ to $S_m$, a delay amount of the horizontal scanning pulse SP attributable to the interconnection resistance is larger at the positions more distant from both the scanning drivers 2A and 2B, i.e., at the positions closer to the screen center. Therefore, when the scanning drivers 2A and 2B apply the horizontal scanning pulse SP to the horizontal scan lines S, the horizontal scanning pulse SP reaches a crossing part between the horizontal scan line S and a data line $D_{n/2}$ (or $D_{(n/2)+1}$) belonging to the screen center area later by time WD than the horizontal scanning pulse SP reaching a crossing part between the horizontal scan line S and the data line $D_1$ (or $D_n$) belonging to the screen left (or right) end area as illustrated in FIG. 12, for example. In this case, if the data driver 3 simultaneously applies the same pixel drive voltage G to the data line $D_1$ (or $D_n$) and the data line $D_{n/2}$ (or $D_{(n/2)+1}$) in synchronization with application of the horizontal scanning pulse SP, the pixel drive voltage G applied to both the data lines D rises gradually and reaches a desired peak voltage PV at substantially the same timing as illustrated in FIG. 12. For example, as illustrated in FIG. 12, in the display cell at the crossing part between the horizontal scan line S and the data line $D_1$ (or $D_n$), display is performed with a luminance level corresponding to 80% of the maximum value of the pixel drive voltage G applied to the data line $D_1$ (or $D_n$), i.e., the peak voltage PV of the pixel drive voltage G, while the horizontal scanning pulse SP is applied to the horizontal scan line S. The horizontal scanning pulse SP reaches the display cell at the crossing part between the horizontal scan line S and the data line $D_{n/2}$ (or $D_{(n/2)+1}$) with a delay of the time WD. Accordingly, as illustrated in FIG. 12 for example, the voltage value of the pixel drive voltage G applied to the data line $D_{n/2}$ (or $D_{(n/2)+1}$) reaches the peak voltage PV while the horizontal scanning pulse SP is applied. Therefore, in the display cell at the crossing part between the horizontal scan line S and the data line $D_{n/2}$ (or $D_{(n/2)+1}$), display is performed with a luminance level corresponding to the maximum value of the pixel drive voltage G applied to the data line $D_1$ (or $D_n$), i.e., the peak voltage PV of the pixel drive voltage G, while the horizontal scanning pulse SP is applied to the horizontal scan line S as illustrated in FIG. 12. Consequently, the display luminance of the display cell connected to the data line $D_1$ (or $D_n$) belonging to the screen left (or right) end area and the display luminance of the display cell connected to the data line $D_{n/2}$ (or $D_{(n/2)+1}$) belonging to the screen center area do not coincide, which results in occurrence of display unevenness.

The data driver 3 applies the pixel drive voltages G to the data lines D that intersect the horizontal scan lines S at the positions where delay time is larger, at timing later than timing of applying the pixel drive voltages to the data lines D that intersect the scanning lines S at positions where the delay time is smaller, the delay time being a period of time from start point of application of the horizontal scanning pulse SP by the scanning drivers 2A and 2B to actual arrival point of the scanning pulse SP. For example, as illustrated in FIG. 1, when the scanning drivers 2A and 2B are each placed on both ends of the horizontal scan lines S, the delay time until arrival of the horizontal scanning pulse SP on the horizontal scan lines S becomes larger from the screen right or left end area toward the screen center area as illustrated in FIG. 11. In conformity with the pattern of the delay time of the horizontal scanning pulse SP, the data driver 3 delays the application timing of the pixel drive voltages G more as the data lines D are closer to the screen center where the delay time until the arrival of the horizontal scanning pulse SP is larger as illustrated in FIG. 11.

Figure 13:
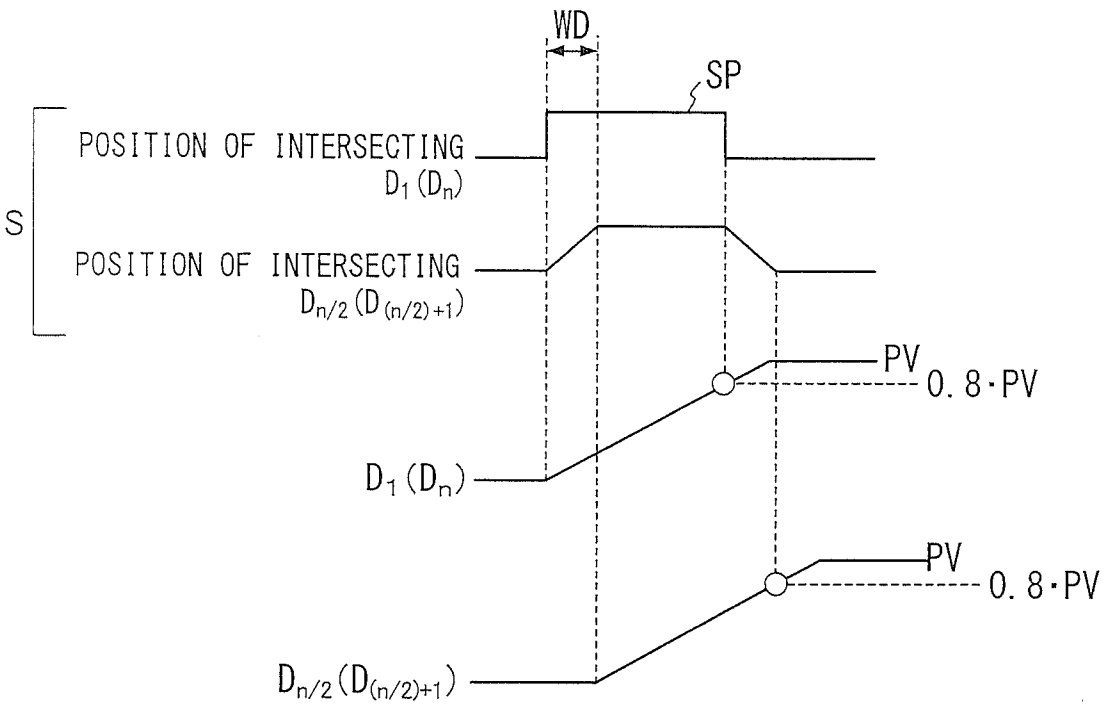
FIG. 13 is a waveform chart illustrating a pixel drive voltage and a horizontal scanning pulse when the pixel drive voltage applied to the data line $D_{n/2}$ (or $D_{(n/2)+1}$) belonging to the screen center area is delayed from the pixel drive voltage applied to the data line $D_1$ (or $D_n$) belonging to the screen left (or right) end area.

For example, as illustrated in FIG. 13, when the horizontal scanning pulse SP reaches a crossing position between the data line $D_{n/2}$ (or $D_{(n/2)+1}$) belonging to the screen center area and the horizontal scanning line S later by time WD than the horizontal scanning pulse SP reaching a crossing position between the data line $D_1$ (or $D_n$) belonging to the screen left (or right) end area and the horizontal scanning line S, the timing of applying the pixel drive voltage G to the data line $D_{n/2}$ (or $D_{(n/2)+1}$) is delayed by the time WD. The data driver 3 applies the pixel drive voltages G to respective ones of the data lines D at a timing corresponding to a scan pulse path length of the scanning line S that intersects the data line D. The scan pulse path length is a length of a distance between an apply point of scanning pulse and an intersection point where the scanning line S intersects the data line D. It can be said that the scan pulse path length (SL) corresponds to a position of a pixel (m, n) which is currently to be instantaneously driven in the display device. Therefore, the scan pulse path length (SL) and the pixel position (m, n) corresponds to each other which can be represented in the form of a function such as SL=SL(m, n), where (m, n) are coordinates of a pixel P(m, n).

As a consequence, as illustrated in FIG. 13, in both the display cell connected to the data line $D_1$ (or $D_n$) and the display cell connected to the data line $D_{n/2}$ (or $D_{(n/2)+1}$), display is performed with a luminance level corresponding to 80% of the peak voltage PV of the pixel drive voltage G. As a result, the display unevenness within the screen is reduced.

As illustrated in FIG. 11, since the data driver 3 shifts the timing of applying the pixel drive voltages G to the respective data lines D, the situation where steep change in currents that flow into the respective data lines simultaneously occurs can be avoided and thereby the noise generated in such a situation can be suppressed.

Therefore, according to the present invention, the display unevenness in the screen attributable to a difference in arrival delay time of the horizontal scanning pulse SP at the respective positions on the horizontal scan lines S is suppressed, while the situation of steep and simultaneous change in currents that flow into the respective data lines can be avoided, so that the noise generated in such a situation can be suppressed.

In order to shift the timing of applying the pixel drive voltages G to the respective data lines D, the driver ICs 3*a* to 3*e* of the data driver 3 supply delay capture clock signals $CL_1$ to $CL_K$ having rising (or falling) edge timing different from each other as illustrated in FIG. 5, to the respective clock input terminals of latches $\mathbf{33}_1$ to $\mathbf{33}_K$ of the second data latch part 133, respectively. To generate delay capture clock signals $CL_1$ to $CL_K$, the driver ICs 3*a* to 3*e* each have a shift register that includes DFFs $\mathbf{32}_1$ to $\mathbf{32}_K$ of a clock synchronization scheme. The DFFs $\mathbf{32}_1$ to $\mathbf{32}_K$ are connected in series and are each operative with the reference clock signal CK as illustrated in FIG. 3. Outputs of the respective DFFs $\mathbf{32}_1$ to $\mathbf{32}_K$ in this shift register are supplied to the respective clock input terminals of the latches $\mathbf{33}_1$ to $\mathbf{33}_K$ as delay capture clock signals $CL_1$ to $CL_K$.

Therefore, according to the configuration illustrated in FIG. 3, it becomes possible to suppress variations in the delay amount of the respective delay capture clock signals CL caused by the influence of manufacturing variations, environmental temperature, and the like, as compared with the case where delay capture clock signals CL different in edge timing are generated by utilizing output delay of the elements such as inverter elements themselves.

According to the configuration illustrated in FIG. 3, the delay amount of the respective delay capture clock signals CL can be adjusted by changing the frequency of the reference timing signal RS supplied from the outside of the driver ICs 3*a* to 3*e*. This makes it possible to adapt to the specifications of various display devices. Therefore, according to the above-stated configuration, it becomes possible to provide a versatile driver which suppresses the noise generated in occasion of steep and simultaneous change in currents that flow into respective data lines, the versatile driver being resistant to the influence of manufacturing variations, environmental temperature, and the like, and adaptable to the specifications of various kinds of display devices.

In the configuration illustrated in FIG. 3, the delay capture clock signals $CL_1$ to $CL_K$ different in timing from each other are generated by using a single shift register ($\mathbf{31}_1$ to $\mathbf{31}_K$, $\mathbf{32}_1$ to $\mathbf{32}_K$) and a single clock signal (CK). However, the above-stated delay capture clock signals $CL_1$ to $CL_K$ may be generated by using a plurality of shift registers operative with clock signals different in phase from each other.

Figure 14:
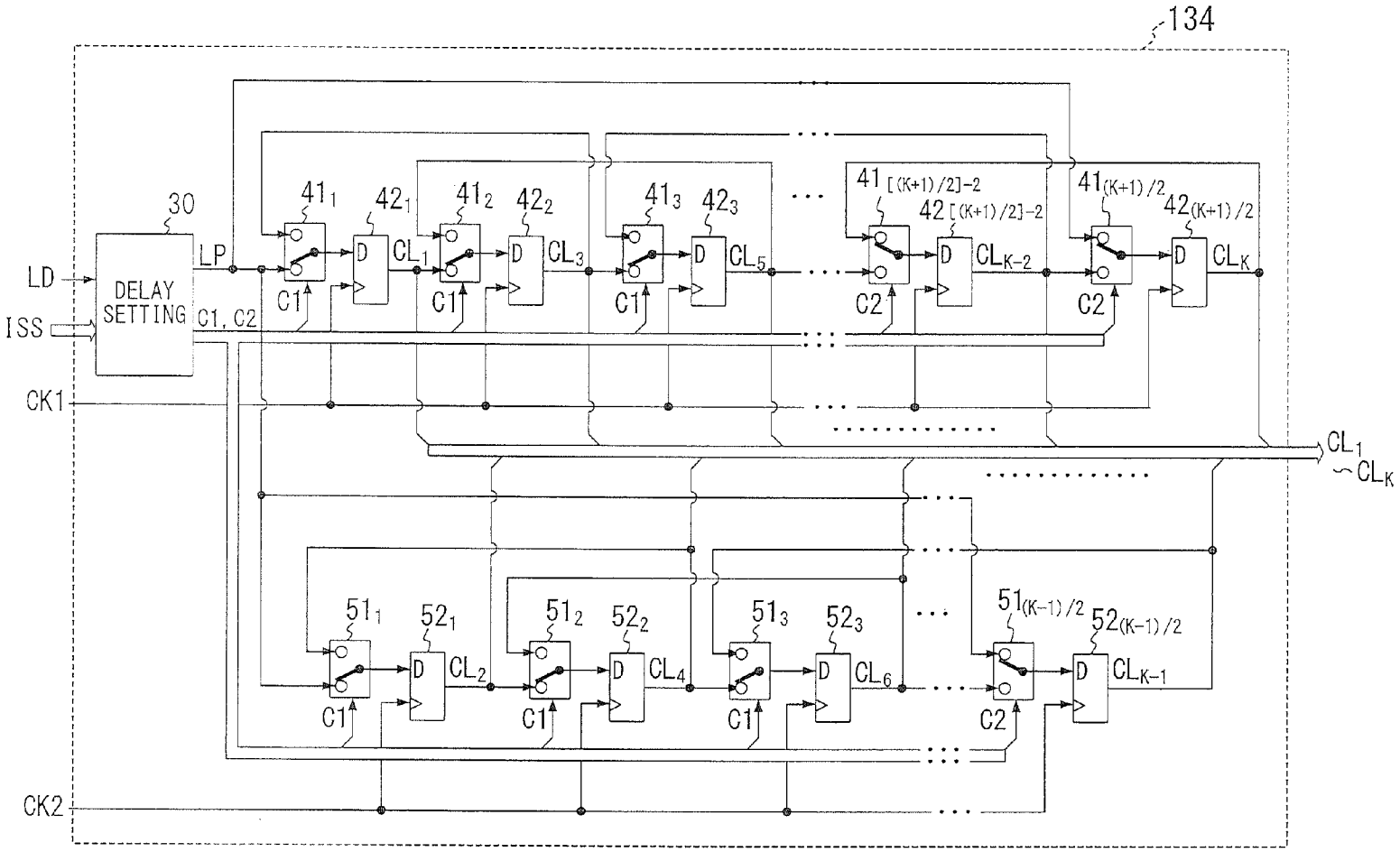
FIG. 14 is a circuit diagram illustrating another example of the internal configuration of the delay control circuit 134.
Figure 15:
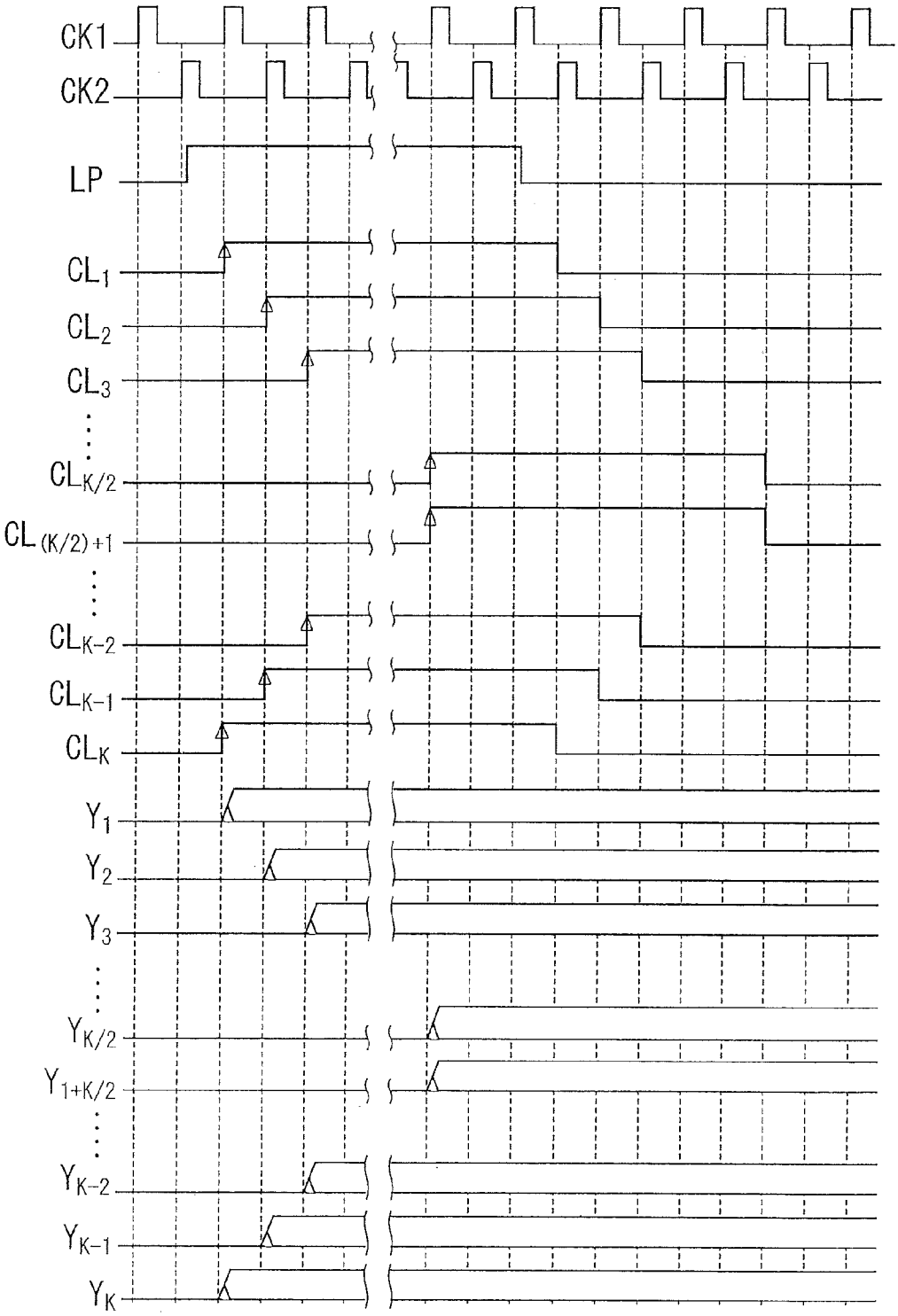
FIG. 15 is a time chart illustrating internal operation at the time of operating the delay control circuit 134 illustrated in FIG. 14 in the V shift mode.

FIG. 14 is a circuit diagram illustrating another example of the internal configuration of the delay control circuit 134 made in view of this point. In the configuration illustrated in FIG. 14, a single resister including the above-stated shift direction switches $\mathbf{31}_1$ to $\mathbf{31}_K$ and the DFFs $\mathbf{32}_1$ to $\mathbf{32}_K$ are divided into a first shift register including shift direction switches $\mathbf{41}_1$ to $\mathbf{41}_{(K+1)/2}$, and DFFs $\mathbf{42}_1$ to $\mathbf{42}_{(K+1)/2}$, and a second shift register including shift direction switches $\mathbf{51}_1$ to $\mathbf{51}_{(K=-1)/2}$, and DFFs $\mathbf{52}_1$ to $\mathbf{52}_{(K-1)/2}$. The delay setting part 30 illustrated in FIG. 3 is used in this configuration without any change. The receiving circuit 131 generates reference clock signals CK1 and CK2 in place of the single reference clock signal CK. The reference clock signals CK1 and CK2 have a frequency that is half the frequency of the reference clock signal CK, and their phases are different from each other as illustrated in FIG. 15. The receiving circuit 131 supplies the reference clock signal CK1 to the DFFs $\mathbf{42}_1$ to $\mathbf{42}_{(K+1)/2}$ of the first shift register, and supplies the reference clock signal CK2 to the DFFs $\mathbf{52}_1$ to $\mathbf{52}_{(K-1)/2}$ of the second shift register. In response to the load signal LP supplied from the delay setting part 30, shift operation of the first and second shift register is started at the same time. Accordingly, as illustrated in FIG. 15 for example, the DFFs $\mathbf{42}_1$ to $\mathbf{42}_{(K+1)/2}$ of the first shift register each output odd-numbered delay capture clock signals $CL_1, CL_3, CL_5, \ldots, CL_K$, among the delay capture clock signals $CL_1$ to $CL_K$, in synchronization with the reference clock signal CK1. As illustrated in FIG. 15 for example, the DFFs $\mathbf{52}_1$ to $\mathbf{52}_{(K-1)/2}$ of the second shift register each output even-numbered delay capture clock signals $CL_2, CL_4, CL_6, \ldots, CL_{K-1}$, among the delay capture clock signals $CL_1$ to $CL_K$, in synchronization with the reference clock signal CK2.

Therefore, according to the configuration illustrated in FIG. 14, the frequency of the reference clock signals CK1 and CK2, which operate the first and second shift registers, respectively, is set to half the frequency of the reference clock signal CK supplied to operate the single shift register illustrated in FIG. 3. This increases an operation margin provided to reliably operate the shift registers.

In the embodiment illustrated in FIG. 3, the delay control circuit 134 controls the respective delay amounts of K pixel drive voltages $G_1$ to $G_K$ by using K delay capture clock signals $CL_1$ to $CL_K$. However, the delay control circuit 134 may control the delay amount in units of groups each including two or more pixel drive voltages G. In this case, the number of the delay capture clock signals CL to be generated can be reduced, so that the number of DFFs in the above-stated shift register is also reduced accordingly. As a result, downsizing of the apparatus can be achieved.

In the V shift mode, the above-stated delay control circuit 134 makes the DFFs $\mathbf{32}_1$ to $\mathbf{32}_{K/2}$ belonging to the left area LA capture the load signal LP while shifting the load signal LP to subsequent DFFs in order of $\mathbf{32}_1$ to $\mathbf{32}_{K/2}$. The delay control circuit 134 also makes the DFF $\mathbf{32}_{(K/2)+1}$ to $\mathbf{32}_K$ belonging to the right area RA capture the load signal LP while shifting the load signal LP to the subsequent DFFs in order of $\mathbf{32}_K$ to $\mathbf{32}_{(K/2)+1}$. However, the number of the DFFs 32 belonging to the left area LA (or right area RA) needs not necessarily be K/2. More specifically, in the V shift mode, the DFFs $\mathbf{32}_1$ to $\mathbf{32}_f$ (f is a natural number of 2 or more) belonging to the left area LA may be configured to capture the load signal LP while shifting the load signal LP to the subsequent DFFs in order of $\mathbf{32}_1$ to $\mathbf{32}f$, while the DFFs $\mathbf{32}_{f+1}$ to $\mathbf{32}_K$ belonging to the right area RA may be configured to capture the load signal LP while shifting the load signal LP to the subsequent DFFs in order of $\mathbf{32}_K$ to $\mathbf{32}_{f+1}$.

In the above embodiment, the first data latch part 132 cannot start capturing of the pixel data corresponding to the next one horizontal scan line unless the respective second data latch parts 133 of the driver ICs 3*a* to 3*e* finish supplying all the pixel data to the gradation voltage conversion circuit 135. Accordingly, in the case of applying the pixel drive voltages G to the data lines D of the display device 20 in each horizontal scanning period in accordance with the delay configuration as illustrated in FIG. 11 for example, it is necessary to prevent maximum delay time $T_{MAX}$, which starts at the time of supplying the load signal LD, from elongating into the next horizontal scanning period. This requires limitation of the maximum delay time $T_{MAX}$ or expansion of the horizontal scanning period.

A buffer data latch may be provided between the first data latch part 132 and the second data latch part 133 so that capturing of the pixel data corresponding to the next one horizontal scan line can be started before the second data latch part 133 finishes supplying all the pixel data to the gradation voltage conversion circuit 135.

Figure 16:
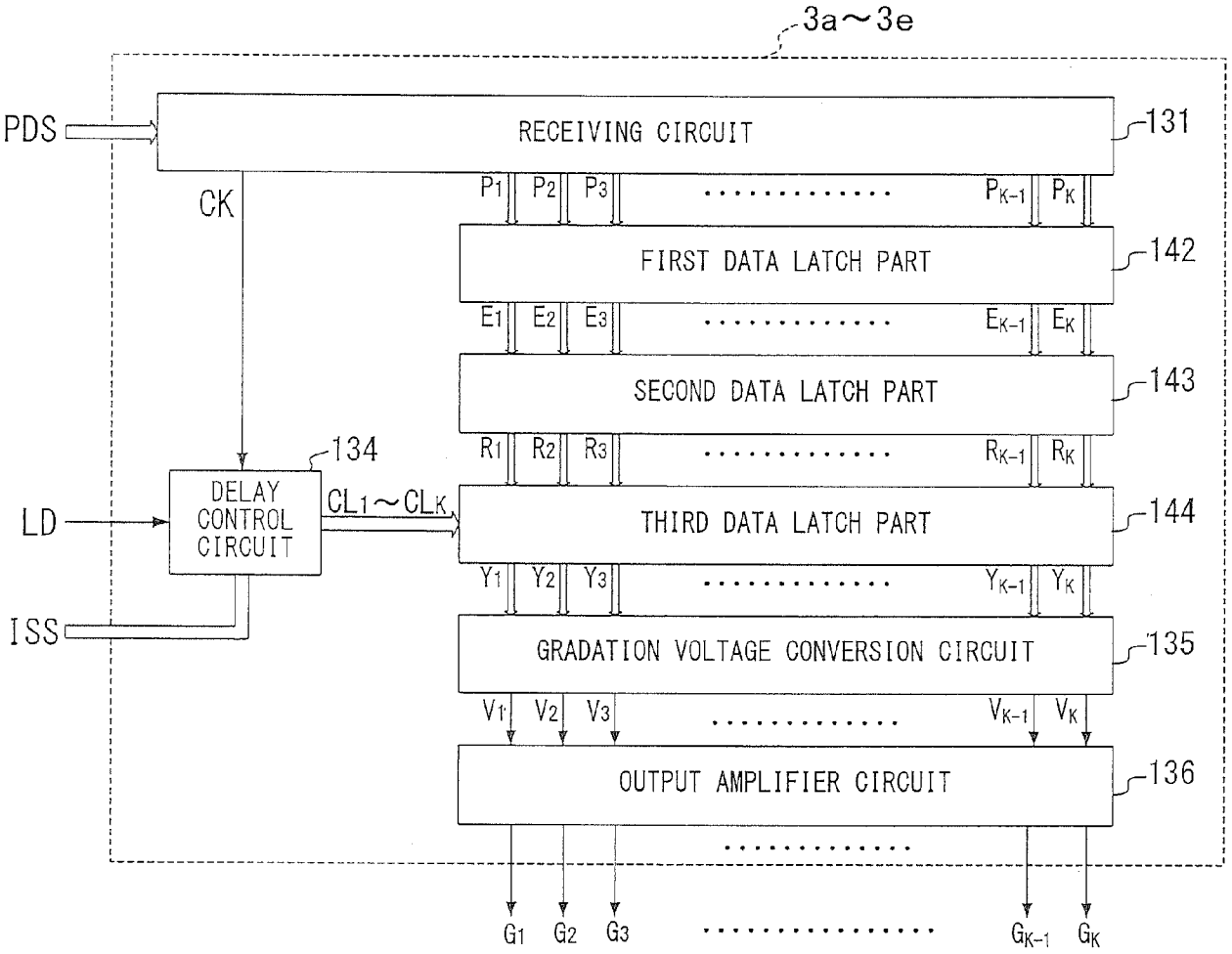
FIG. 16 is a block diagram illustrating another example of the internal configuration of each of the driver ICs 3*a* to 3*e*.

FIG. 16 is a block diagram illustrating another internal configuration of the respective driver ICs 3*a* to 3*e* made in view of this point. In the driver IC illustrated in FIG. 16, a first data latch part 142 and a second data latch part 143 are provided in place of the first data latch part 132 and the second data latch part 133 illustrated in FIG. 2. Furthermore, a third data latch part 144 is newly provided between the second data latch part 143 and the gradation voltage conversion circuit 135. Other configuration aspects are identical to those illustrated in FIG. 2.

In FIG. 16, the first data latch part 142 captures each of the pixel data $P_1$ to $P_K$ supplied from the receiving circuit in order of being supplied, and supplies the captured data as pixel data $E_1$ to $E_K$ to the subsequent second data latch part 143. The second data latch part 143 captures the pixel data $E_1$ to $E_K$ at the same time, and supplies each of captured data as pixel data $R_1$ to $R_K$ to the subsequent third data latch part 144. The third data latch part 144 has the same internal configuration as the second data latch part 133 illustrated in FIG. 3. Like the second data latch part 133, the third data latch part 144 captures the above-stated pixel data $R_1$ to $R_K$ delayed in accordance with the delay configuration illustrated in FIG. 5, 7 or 9, in response to the delay capture clock signals $CL_1$ to $CL_K$ supplied from the delay control circuit 134, and supplies the captured data to the gradation voltage conversion circuit 135 as pixel data $Y_1$ to $Y_K$.

Therefore, according to the configuration illustrated in FIG. 16, the second data latch part 143 functions as a buffer memory, so that the first data latch part 142 can start capturing of the pixel data corresponding to the next one horizontal scan line even when the third data latch part 144 is still in the middle of sending out the pixel data $Y_1$ to $Y_K$. This makes it unnecessary to limit the maximum delay time $T_{MAX}$ and expand the horizontal scanning period at the time of delaying and applying the pixel drive voltages G.

The above-disclosed embodiment employs a so-called clock data recovery scheme in which a pixel data signal PDS having a reference timing signal RS superimposed thereon is supplied to the driver ICs 3*a* to 3*e* and a reference clock signal CK is reproduced in the respective driver ICs 3 on the basis of this reference timing signal RS. According to this scheme, the clock signal is supplied to each of the driver ICs 3*a* to 3*e* from the outside. However, the drive controller 1 may supply the reference clock signal CK directly to the respective driver ICs 3*a* to 3*e* without adopting such a clock data recovery scheme.

Figure 17:
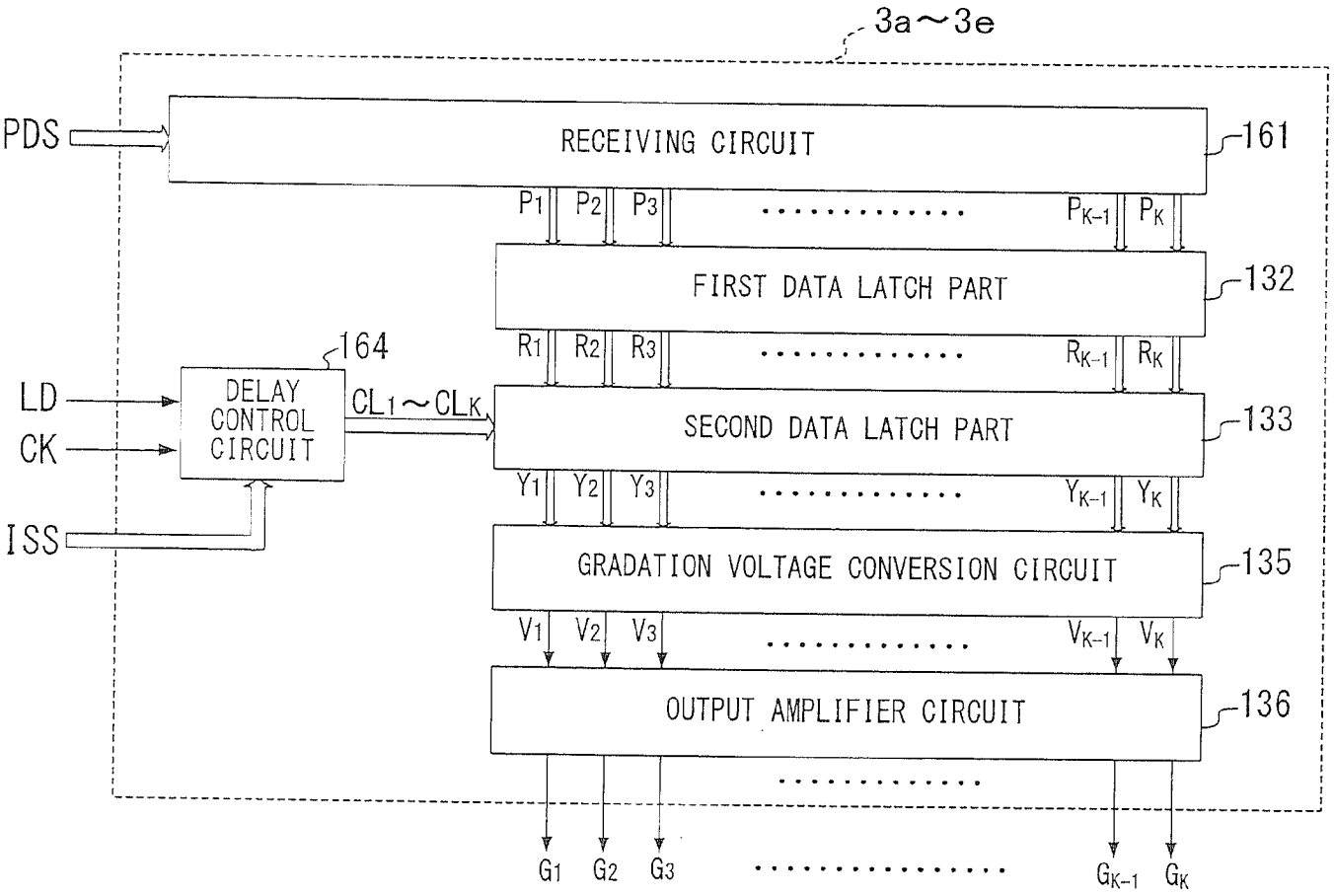
FIG. 17 is a block diagram illustrating another example of the internal configuration of each of the driver ICs 3*a* to 3*e*.

FIG. 17 is a block diagram illustrating the internal configuration of the respective driver ICs 3*a* to 3*e* made in view of this point. In the configuration illustrated in FIG. 17, a receiving circuit 161 is adopted in place of the receiving circuit 131, and a delay control circuit 164 is adopted in place of the delay control circuit 134. Other configuration aspects are identical to those illustrated in FIG. 2.

In FIG. 17, like the receiving circuit 131, the receiving circuit 161 captures a sequence of pixel data PD from a pixel data signal PDS supplied from the drive controller 1, and supplies the pixel data PD for one horizontal scan line (n pieces) to the first data latch part 132 as pixel data $P_1$ to $P_K$. Unlike the receiving circuit 131, the receiving circuit 161 does not reproduce the reference clock signal CK. In this case, the drive controller 1 supplies the above-stated reference clock signal CK directly to the delay control circuits 164 of the respective driver ICs 3*a* to 3*e*. Like the delay control circuit 134, the delay control circuit 164 performs initial setting in response to the initial setting signal ISS, and then generates the delay capture clock signals $CL_1$ to $CL_K$ synchronized with the reference clock signal CK, in response to the load signal LD. The delay control circuit 164 then supplies the delay capture clock signals $CL_1$ to $CL_K$ to the second data latch part 133. More specifically, the shift registers formed in the delay control circuits of the respective driver ICs 3*a* to 3*e* capture a single pulse load signal while sequentially shifting the single pulse load signal to the subsequent stages, in synchronization with the reference clock signal CK serving as a reference timing signal supplied from the outside. As a result, the delay capture clock signals $CL_1$ to $CL_K$ are generated.

This application is based on Japanese Patent Application No. 2014-017237 which is herein incorporated by reference.

What is claimed is:

1. A display device driver for driving a display device in response to a video signal, said display device including a screen containing a plurality of scanning lines and a plurality of data lines that respectively intersect the scanning lines so as to form pixels at the intersection point therebetween, said display device driver comprising:

a scanning driver that applies scanning pulses in sequence to respective ones of said plurality of scanning lines; and a data driver that applies pixel drive voltages to the respective ones of said data lines, said pixel drive voltages each varying in correspondence to luminance levels represented by said video signal at the respective pixels, wherein said data driver applies said pixel drive voltages at timings each corresponding to a scan pulse path length of the scanning line that intersects said one of data lines, said scan pulse path length being equal to a length of a distance between an apply point of a scanning pulse and an intersection point where a scanning line intersects said data line.

2. The display device driver according to claim 1, wherein said data driver includes a first driver that applies the pixel drive voltages to the data lines belonging to a screen left area of said display device, and a second driver that applies the pixel drive voltages to the data lines belonging to a screen right area of said display device, the first and second drivers each include:

a data latch part including first to K-th latches that capture and output K (K is a natural number of 2 or more) pieces of pixel data indicative of the luminance levels of respective pixels in synchronization with first to K-th capture clock signals each having different edge timing;

an output amplifier that generates voltages corresponding to the luminance levels indicated by the pixel data pieces output from the first to K-th latches as the pixel drive voltages, respectively; and first to K-th flip-flops connected in series in K stages that capture a load signal synchronized with a horizontal synchronizing signal in the video signal while sequentially shifting the load signal to subsequent stages in synchronization with a reference timing signal, and the first and second drivers each supply outputs of the first to K-th flip-flops to the first to K-th latches as the first to K-th capture clock signals, respectively.

3. The display device driver according to claim 2, wherein the first driver shifts the load signal to subsequent flip-flops in order of the first to K-th flip-flops, and said second driver shifts the load signal to subsequent flip-flops in order of the K-th to first flip-flops.

4. The display device driver according to claim 1, wherein the data driver includes:

a first driver that applies the pixel drive voltages to the data lines belonging to a screen left area of said display device;

a second driver that applies the pixel drive voltages to the data lines belonging to a screen right area of said display device; and a third driver that applies the pixel drive voltages to the data lines belonging to a screen center area of said display device, the first to third drivers each include:

a data latch part including first to K-th latches that capture and output K pieces of pixel data indicative of the luminance levels of respective pixels in synchronization with first to K-th capture clock signals each having different edge timing;

an output amplifier that generates voltages corresponding to the luminance levels indicated by the pixel data pieces each output from the first to K-th latches as the pixel drive voltages, respectively; and first to K-th flip-flops connected in series in K stages that capture a load signal synchronized with a horizontal synchronizing signal in the video signal while sequentially shifting the load signal to subsequent stages in synchronization with a reference timing signal, and the first to third drivers each supply outputs of the first to K-th flip-flops to the first to K-th latches as the first to K-th capture clock signals, respectively.

5. The display device driver according to claim 4, wherein said first driver shifts the load signal to subsequent flip-flops in order of the first to K-th flip-flops, said second driver shifts the load signal to subsequent flip-flops in order of the K-th to first flip-flops, and said third driver shifts the load signal to subsequent flip-flops in order of the first to f-th flip-flops (f is a natural number of 2 or more and less than K), while shifting the load signal to subsequent flip-flops in order of the K-th to (f+1)th flip-flops.

6. The display device according to claim 1, wherein said data driver includes a memory which stores delay time information indicating application timings of the respective ones of said pixel drive voltages.

7. A display device driver for driving a display device in response to a video signal, said display device including a screen containing a plurality of scanning lines and a plurality of data lines that respectively intersect the scanning lines so as to form pixels at the intersection point therebetween, said display device driver comprising:

a scanning driver that applies scanning pulses in sequence to respective ones of said plurality of scanning lines; and a data driver that applies pixel drive voltages to the respective ones of said data lines, said pixel drive voltages each varying in correspondence to luminance levels represented by said video signal at the respective pixels, wherein each pixel drive voltages applied to one of said data lines changes at timings corresponding to a scan pulse path length of the scanning line that intersects said one of data lines, said scan pulse path length being equal to a length of a distance between an apply point of a scanning pulse and an intersection point where a scanning line intersects said data line, said scanning driver includes a first scanning driver that applies the scanning pulse from one end of each of said plurality of scanning lines, and a second scanning driver that applies the scanning pulse from the other end of each of the plurality of scanning lines, and said data drivers respectively applies the pixel drive voltages at more delayed timing to data lines which are placed at positions closer to a central area of said screen of the display device among the respective data lines.

8. A display device driver for driving a display device in response to a video signal, said display device including a screen containing a plurality of scanning lines and a plurality of data lines that respectively intersect the scanning lines so as to form pixels at the intersection point therebetween, said display device driver comprising:

a scanning driver that applies scanning pulses in sequence to respective ones of said plurality of scanning lines; and a data driver that applies pixel drive voltages to the respective ones of said data lines, said pixel drive voltages each varying in correspondence to luminance levels represented by said video signal at the respective pixels, wherein the data driver applies the pixel drive voltages to data lines that intersect the scanning lines at positions where delay time is larger, at timing later than timing of applying the pixel drive voltages to the data lines that intersect the scanning lines at positions where the delay time is smaller, the delay time being a period of time between start of application of the scanning pulse by the scanning driver and arrival of the scanning pulse.

* * * * *